US008968492B2

(12) United States Patent
Uchida

(10) Patent No.: US 8,968,492 B2
(45) Date of Patent: Mar. 3, 2015

(54) LEAD-FREE FREE-MACHINING BRASS HAVING IMPROVED CASTABILITY

(75) Inventor: Toru Uchida, Fukuoka-Ken (JP)

(73) Assignee: Toto Ltd., Fukuoka-ken (JP)

( * ) Notice: Subject to any disclaimer, the term of this patent is extended or adjusted under 35 U.S.C. 154(b) by 1456 days.

(21) Appl. No.: 12/308,966

(22) PCT Filed: Oct. 1, 2008

(86) PCT No.: PCT/JP2008/067853
§ 371 (c)(1),
(2), (4) Date: Dec. 30, 2008

(87) PCT Pub. No.: WO2009/048008
PCT Pub. Date: Apr. 16, 2009

(65) Prior Publication Data

US 2009/0263272 A1 Oct. 22, 2009

(30) Foreign Application Priority Data

Oct. 10, 2007 (JP) ..... 2007-264490
Jan. 9, 2008 (WO) ..... PCT/JP2008/050145
Jun. 16, 2008 (JP) ..... 2008-157024

(51) Int. Cl.
*C22C 9/04* (2006.01)
*B22C 9/22* (2006.01)

(52) U.S. Cl.
CPC .... *C22C 9/04* (2013.01); *B22C 9/22* (2013.01)
USPC ..... 148/434; 148/432; 420/471; 420/476

(58) Field of Classification Search
CPC ..... C22C 9/04
USPC ..... 148/432–436; 420/476–482
See application file for complete search history.

(56) References Cited

U.S. PATENT DOCUMENTS 5,288,458 A * 2/1994 McDevitt et al. ..... 420/477
5,630,984 A 5/1997 Waschke et al.

FOREIGN PATENT DOCUMENTS

| | | | |
|---|---|---|---|
| JP | 07-310133 | A | 11/1995 |
| JP | 08-503520 | | 4/1996 |
| JP | 2000-239765 | | 9/2000 |
| JP | 2001-059123 | | 3/2001 |
| JP | 2005-290475 | A | 10/2005 |
| WO | WO 93/24670 | | 12/1993 |
| WO | WO 2006/016630 | | 2/2006 |

OTHER PUBLICATIONS

English language machine translation of JP 2005-290475 to Yamagishi. Generated Feb. 26, 2012.*

* cited by examiner

*Primary Examiner* — Brian Walck
(74) *Attorney, Agent, or Firm* — Carrier Blackman & Associates, P.C.; Joseph P. Carrier; William D. Blackman

(57) ABSTRACT

There is provided a brass free from lead (Pb) and possessing excellent machinability, castability, mechanical properties and other properties. A brass consisting of not less than 55% by weight and not more than 75% by weight of copper (Cu), not less than 0.3% by weight and not more than 4.0% by weight of bismuth (Bi), and y % by weight of boron (B) and x % by weight of silicon (Si), y and x satisfying the following requirements: $0 \le x \le 2.0$, $0 \le y \le 0.3$, and $y > -0.15x + 0.015ab$, wherein a is 0.2 when Bi is 0.3% by weight $\le Bi < 0.75\%$ by weight; 0.85 when Bi is 0.75% by weight $\le Bi < 1.5\%$ by weight; and 1 when Bi is 1.5% by weight $\le Bi \le 4.0\%$ by weight, b is 1 when the apparent content of zinc (Zn) is not less than 37% and less than 41%; and 0.75 when the apparent content of Zn is not less than 41% and not more than 45%, the balance consisting of Zn and unavoidable impurities, is excellent in castability, as well as, for example, in machinability and mechanical properties.

9 Claims, 1 Drawing Sheet

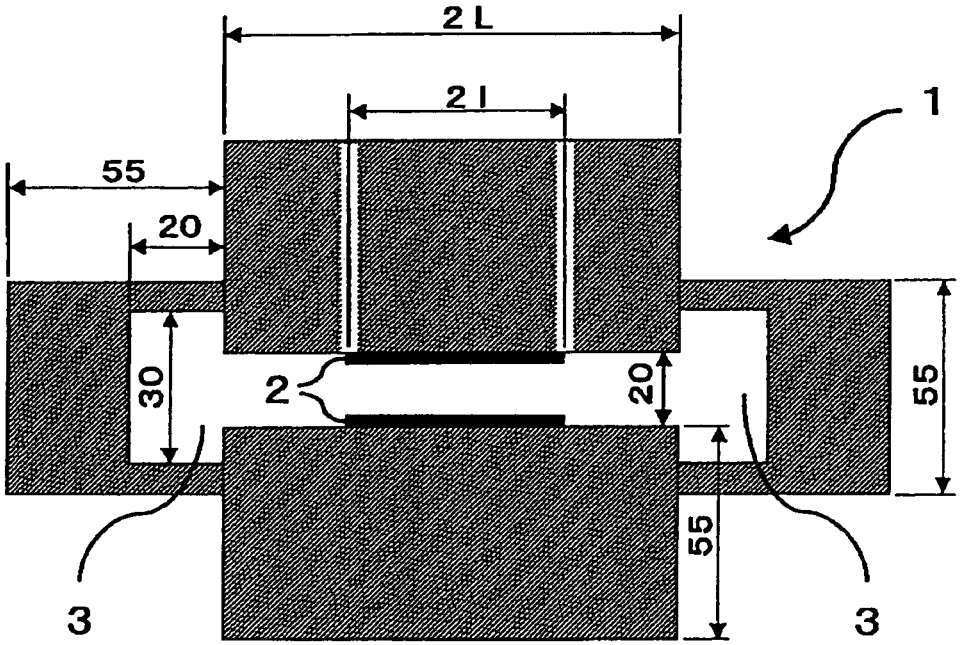
2L
2l
1
55
20
30
2
20
55
55
3
3

LEAD-FREE FREE-MACHINING BRASS HAVING IMPROVED CASTABILITY

RELATED APPLICATIONS

This application is based upon and claims the benefit of priority from the prior Japanese Patent Application No. 264490/2007 filed on Oct. 10, 2007, PCT/JP2008/050145 filed on Jan. 9, 2008, and Japanese Patent Application No. 157024/2008 filed on Jun. 16, 2008; the entire contents of which are incorporated herein by reference.

BACKGROUND OF THE INVENTION

1. Technical Field

The present invention relates to brass not containing lead, that is, the so-called lead-free brass. More particularly, the present invention relates to brass for casting possessing improved machinability, castability, mechanical properties and other properties, which, by virtue of freedom from lead, can be advantageously used, for example, for water faucet metal fittings.

2. Background Art

Water faucet metal fittings are in general made of brass or bronze. From the viewpoint of improving the machinability of the material, lead (Pb) is added in an amount of about 2 to 3% by weight for brass and in an amount of about 4 to 6% by weight for bronze. In recent years, however, the influence of Pb on the human body and environments has become a concern, and regulations related to Pb have been actively established in various countries. For example, in California, U.S.A., a regulation of the content of Pb in a water tap faucet which should be not more than 0.25% by weight from January, 2010, has come into effect. Further, it is said that the leaching amount of Pb would also be regulated to about 5 ppm in the future. Also in countries other than the U.S.A., the movement of regulations about Pb is significant, and the development of materials which can cope with the regulations of Pb content or leaching amount of Pb has been desired in the art.

Japanese Patent H07 (1995)-310133 A proposes brass with bismuth (Bi) added thereto instead of Pb because Bi behaves similarly to Pb in brass. Further, Japanese Patent 2005-290475 A discloses that, in a Bi-added system, for example, boron (B) and nickel (Ni) are added from the viewpoint of improving the machinability. Furthermore, Japanese Patent 2001-59123 A discloses that, in a Bi-added system, the addition of iron (Fe) refines crystal grains. In systems disclosed in these prior art techniques, however, there is room for improvement in castability, especially in cracking in casting. Accordingly, there is still a demand for the development of brass free from Pb and having improved castability, machinability, mechanical properties and other properties.

SUMMARY OF THE INVENTION

The present inventors have now found that, in brass with Bi added thereto instead of Pb, the addition of B and Si in a predetermined amount relation can realize brass which is effective in preventing casting cracking and, at the same time, is excellent in machinability, mechanical properties, corrosion resistance and other properties. The present inventors have also found that additive elements such as Ni, Al, and Sn, which are commonly added for improving the properties of brass, affect casting cracking, and the casting cracking can be prevented by adding B and Si in a predetermined amount relation. The present invention has been based on such finding.

Accordingly, an object of the present invention is to provide brass which is free from Pb and is excellent in machinability, castability, mechanical properties and other properties.

Thus, according to the present invention, there is provided a brass having a crystal texture in which the total proportion of α phase and β phase is not less than 85%, and consisting of:

not less than 55% by weight and not more than 75% by weight of copper (Cu), not less than 0.3% by weight and not more than 4.0% by weight of bismuth (Bi), and y % by weight of boron (B) and x % by weight of silicon (Si), y and x satisfying the following requirements:

$0 \le x \le 2.0$, $0 \le y \le 0.3$, and $y > -0.15x + 0.015ab$ wherein a is 0.2 when Bi is 0.3% by weight $\le Bi < 0.75$% by weight; 0.85 when Bi is 0.75% by weight $\le Bi < 1.5$% by weight; and 1 when Bi is 1.5% by weight $\le Bi \le 4.0$% by weight, and b is 1 when the apparent content of zinc (Zn) is not less than 37% and less than 41%; and 0.75 when the apparent content of Zn is not less than 41% and not more than 45%, and the balance consisting of Zn and unavoidable impurities.

BRIEF DESCRIPTION OF THE DRAWINGS

FIG. 1 is a diagram showing the shape of mold 1 used in a both end restriction test method for evaluating casting cracking resistance.

DETAILED DESCRIPTION OF THE INVENTION

Definition

In the present invention, the term "unavoidable impurities" as used herein means elements present in an amount of less than 0.1% by weight unless otherwise specified. In this connection, it should be noted that Sb, P, As, Mg, Se, Te, Fe, Co, Zr, Cr, and Ti are included in the unavoidable impurities but may be added in respective amounts which are specified in the present specification. The content of the unavoidable impurities is preferably less than 0.05% by weight.

α Phase/β Phase

In the brass according to the present invention, the total proportion of α phase and β phase is not less than 85%, preferably not less than 90%. The crystalline texture composed mainly of α phase and β phase can realize brass having good castability. In the present invention, preferably, the crystallization of dendrite of proeutectic α phase is avoided. In the present invention, the total proportion of α phase and β phase is based on the area ratio of the cross section of the crystals. For example, the total area ratio of α phase and β phase may be determined, for example, by subjecting a photograph of a crystalline texture taken with an optical microscope to image processing.

Bi

The brass according to the present invention contains not less than 0.3% by weight and not more than 4.0% by weight of bismuth (Bi). Bi behaves similarly to Pb in the brass, and, thus, instead of Pb, imparts machinability comparable with the machinability imparted by Pb. In the present invention, the content of Bi is not less than 0.3% by weight from the viewpoint of realizing good machinability. However, when the content of Bi is excessively large, the aggregation of Bi is likely to occur. The aggregated part is likely to become a starting point of casting cracking. For this reason, the upper limit of the Bi content is 4.0% by weight. In a preferred embodiment of the present invention, the lower limit of the Bi content is 0.5% by weight. The lower limit of the Bi content is more preferably 1.0% by weight from the viewpoint of the machinability. The upper limit of the Bi content is preferably 3.0% by weight, more preferably 2.0% by weight.

According to the present invention, good machinability can be realized even when the material does not contain Pb at all. Preferably, the material does not contain Pb at all. Even though Pb is contained in the material, the Pb content should be on such a level that is tolerable as an unavoidable impurity. More specifically, the Pb content is not more than 0.5% by weight, preferably not more than 0.1% by weight, from the viewpoint of the influence of Pb on the human body and environments.

B and Si

In the present invention, B accelerates the refinement of crystals (especially proeutectic β phase), and, consequently, Bi can be finely dispersed to effectively prevent cracking in casting. Si is dissolved in solution in β phase and is estimated to have the function of relaxing the breaking of the interface of Bi, which becomes a starting point of the casting cracking, and the β phase. Further, the brass according to the present invention, by virtue of the refinement, good mechanical properties can also be provided.

The brass according to the present invention comprises B and Si. The content of B and the content of Si satisfy the following requirements: $0 \le y \le 0.3$, $0 \le x \le 2.0$, and $y > -0.15x + 0.015ab$ wherein y represents the content of B, % by weight; x represents the content of Si, % by weight. In this case, coefficients a and b each represent a correction coefficient and are provided for the reason that proper B content and proper Si content vary depending upon the above-described addition amount of Bi and the apparent Zn content which will be described later. Specifically, the coefficient a varies depending upon the content of Bi and is 0.2 when Bi is 0.3% by weight ≤Bi<0.75% by weight; 0.85 when Bi is 0.75% by weight ≤Bi<1.5% by weight; and 1 when Bi is 1.5% by weight ≤Bi≤4.0% by weight. On the other hand, the coefficient b varies depending upon the apparent Zn content is 1 when the apparent Zn content is not less than 37% and less than 41%; and 0.75 when the apparent Zn content is not less than 41% and not more than 45%. In a preferred embodiment of the present invention, y and x are preferably $0 \le y \le 0.03$ and $0 \le x \le 1.8$, respectively, more preferably $0 \le y \le 0.01$ and $0 \le x \le 1.5$, respectively, provided that a relationship represented by $y > -0.15x + 0.015ab$ is satisfied. In order to attain the effect of refining crystals, the addition of B in the lower limit addition amount is necessary. The addition of an excessive amount of B leads to a possibility that the elongation of the alloy is deteriorated. Accordingly, the upper limit of B is 0.3% by weight, preferably 0.03% by weight, more preferably 0.01% by weight.

Further, B combines, for example, with Fe and Cr to form an intermetallic compound. The intermetallic compound possibly forms hard spots which pose problems in the surface processing of the molded product after casting. Accordingly, when the surface of the molded product should be smooth, lowering the addition amount of B and/or lowering the content of Fe, Cr or the like is preferred. Specifically, preferably, the B content is not more than 0.005% by weight, more preferably not more than 0.003% by weight, and the content of Fe, Cr or the like is less than 0.1% by weight.

For Si, the Zn equivalent proposed by Guillet is 10 which will be described later, and the apparent Zn content is increased leading to a possibility that dissimilar phases of γ phase and κ phase are disadvantageously precipitated in the crystalline texture. Accordingly, in one embodiment of the present invention, the addition amount of Si is not more than 2.0% by weight. Preferably, the upper limit of the addition amount of Si is 1.5% by weight.

In the present specification, the apparent Zn content means the amount calculated by the following equation proposed by Guillet. This equation is based on the concept that the addition of additive elements other than Zn exhibits the same tendency as the addition of Zn.

$$\text{Apparent Zn content}(\%) = [(B+tq)/(A+B+tq)] \times 100$$

wherein A represents the content of Cu, % by weight; B represents the content of Zn, % by weight; t represents the Zn equivalent of additive element; and q represents the addition amount of the additive element, % by weight. The Zn equivalent of each element is Si=10, Al=6, Sn=2, Pb=1, Fe=0.9, Mn=0.5, and Ni=−1.3. The Zn equivalent of Bi has not been clearly defined yet. In the present specification, however, the Zn equivalent of Bi is calculated to be 0.6 in view of technical documents and the like. For the other elements, the value is regarded as "1," because the addition amount is very small and the influence on the Zn equivalent value is small.

Cu, Zn and Other Components

The brass according to the present invention comprises not less than 55% by weight and not more than 75% by weight of copper (Cu). When the Cu content is above the upper limit of the above-defined content range, there is a possibility that cracking as a result of dendrite crystallization of proeutectic α phase takes place. On the other hand, when the Cu content is below the lower limit of the above-defined content range, the influence of α phase is not significant. In this case, however, there is a possibility that the properties of the brass are deteriorated. In a preferred embodiment of the present invention, the lower limit of the Cu content is 58% by weight, and the upper limit of the Cu content is 70% by weight.

When the proportion of α+β phase in the crystal phase can be regulated to not less than 85% while the apparent Zn content is 37 to 45%, the Cu content can be the above upper limit. For this reason, the upper limit of the Cu content is high.

The balance of the brass, i.e., components other than described above, according to the present invention consists essentially of zinc (Zn).

The brass according to the present invention may contain various additive components from the viewpoint of reforming the properties of the brass. Further, in the present invention, the presence of unavoidable impurities is not excluded. Preferably, however, the amounts of the unavoidable impurities are as small as possible.

In one embodiment of the present invention, Ni may be added to improve the strength and corrosion resistance of the material. In order to more effectively improve the strength and corrosion resistance by the addition of Ni, preferably, not less than 0.3% by weight of Ni is added. On the other hand, the addition of an excessive amount of Ni is preferably avoided from the viewpoint of casting cracking. Preferably, the upper limit of the Ni content is 2.0% by weight.

In a preferred embodiment of the present invention, the relationship between the addition amount of Ni and the corresponding B and Si contents is as follows.

In the following description, y and x represent the content of B, % by weight, and the content of Si, % by weight, respectively.

When 0.1% by weight ≤Ni<0.3% by weight, (1) $0 < y \le 0.3$ when $0.05ab \le x \le 0.75ab$ and (2) $0 \le y \le 0.3$ when $0.75ab < x \le 2.0$, when 0.3% by weight ≤Ni<1.0% by weight, (1) $-0.15x + 0.03ab < y \le 0.3$ when $0.05ab \le x \le 0.2ab$, (2) $0<y\leq 0.3$ when $0.2ab<x\leq 0.75ab$, (3) $0\leq y\leq 0.3$ when $0.75ab<x\leq 1.75ab$, and (4) $0.004x-0.007(2-ab)<y\leq 0.3$ when $1.75ab<x\leq 2.0$, and when 1.0% by weight $\leq Ni\leq 2.0\%$ by weight, (1) $0.02ab<y\leq 0.3$ when $0.05ab\leq x\leq 0.2ab$, (2) $-0.05x+0.03ab<y\leq 0.3$ when $0.2ab<x\leq 0.3ab$, (3) $0.015ab<y\leq 0.3$ when $0.3ab<x\leq 0.5ab$, (4) $-0.026x+0.028ab<y\leq 0.3$ when $0.5ab<x\leq 1.0ab$, (5) $0.011x-0.009(2-ab)<y\leq 0.3$ when $1.0ab<x\leq 1.5ab$, and (6) $0.0075ab<y\leq 0.3$ when $1.5ab<x\leq 2.0$, wherein a is 0.2 when Bi is 0.3% by weight $\leq Bi<0.75\%$ by weight; 0.85 when Bi is 0.75% by weight $\leq Bi<1.5\%$ by weight; and 1 when Bi is 1.5% by weight $\leq Bi\leq 4.0\%$ by weight, and b is 1 when the apparent content of zinc (Zn) is not less than 37% and less than 41%; and 0.75 when the apparent content of Zn is not less than 41% and not more than 45%.

In a further preferred embodiment of the present invention, the relationship between the addition amount of Ni and the corresponding B and Si contents is as follows.

In the following description, y and x represent the content of B, % by weight, and the content of Si, % by weight, respectively.

When 0.1% by weight $\leq Ni<0.3\%$ by weight, (1) $0.001ab\leq y\leq 0.3$ when $0.05ab\leq x\leq 0.3ab$, (2) $-0.00375x+0.002125ab\leq y\leq 0.3$ when $0.3ab<x\leq 0.5ab$, (3) $-0.001x+0.00075ab\leq y\leq 0.3$ when $0.5ab<x\leq 0.75ab$, and (4) $0\leq y\leq 0.3$ when $0.75ab<x\leq 2.0$, when 0.3% by weight $\leq Ni<1.0\%$ by weight, (1) $-0.1375x+0.03125ab\leq y\leq 0.3$ when $0.05ab\leq x\leq 0.22ab$, (2) $0.001ab\leq y\leq 0.3$ when $0.22ab<x\leq 0.3ab$, (3) $-0.00375x+0.002125ab\leq y\leq 0.3$ when $0.3ab<x\leq 0.5ab$, (4) $-0.001x+0.00075ab\leq y\leq 0.3$ when $0.5ab<x\leq 0.75ab$, (5) $0\leq y\leq 0.3$ when $0.75ab<x\leq 1.75ab$, and (6) $0.006x-0.0105(2-ab)\leq y\leq 0.3$ when $1.75ab<x\leq 2.0$, and when 1.0% by weight $\leq Ni\leq 2.0\%$ by weight, (1) $0.0225ab\leq y\leq 0.3$ when $0.05ab\leq x\leq 0.2ab$, (2) $-0.05x+0.0325ab\leq y\leq 0.3$ when $0.2ab<x\leq 0.3ab$, (3) $0.0175ab\leq y\leq 0.3$ when $0.3ab<x\leq 0.5ab$, (4) $-0.029x+0.032ab\leq y\leq 0.3$ when $0.5ab<x\leq 1.0ab$, (5) $0.0165x-0.0135(2-ab)\leq y\leq 0.3$ when $1.0ab<x\leq 1.5ab$, and (6) $0.01125ab\leq y\leq 0.3$ when $1.5ab<x\leq 2.0$, wherein x, y, a, and b are as defined above.

In another embodiment of the present invention, Al may be added to improve the fluidity and casting surface texture. In order to more effectively improve the fluidity and casting surface texture by the addition of Al, preferably, not less than 0.3% by weight of Al is added. On the other hand, preferably, the addition of an excessive amount of Al is avoided from the viewpoint of casting cracking. The upper limit of the addition amount of Al is preferably 2.0% by weight.

In a preferred embodiment of the present invention, the relationship between the addition amount of Al and the corresponding B and Si contents is as follows.

In the following description, y and x represent the content of B, % by weight, and the content of Si, % by weight, respectively.

When 0.1% by weight $\leq Al<0.3\%$ by weight, (1) $0\leq y\leq 0.3$, $0\leq x\leq 2.0$, and $y>-0.15x+0.015ab$, when 0.3% by weight $\leq Al<1.0\%$ by weight, (1) $-0.15x+0.015ab<y\leq 0.3$ when $0\leq x\leq 0.1ab$, (2) $0<y\leq 0.3$ when $0.1ab<x\leq 1.5ab$, and (3) $0.002x-0.003(2-ab)<y\leq 0.3$ when $1.5ab<x\leq 2.0$, and when 1.0% by weight $\leq Al\leq 2.0\%$ by weight, (1) $0.004ab<y\leq 0.3$ when $0.05ab\leq x\leq 0.3ab$, (2) $-0.01x+0.007ab<y\leq 0.3$ when $0.3ab<x\leq 0.5ab$, (3) $-0.004x+0.004ab<y\leq 0.3$ when $0.5ab<x\leq 1.0ab$, (4) $0.001x-0.001(2-ab)<y\leq 0.3$ when $1.0ab<x\leq 1.5ab$, and (5) $0.0005ab<y\leq 0.3$ when $1.5ab<x\leq 2.0$, wherein a is 0.2 when Bi is 0.3% by weight $\leq Bi<0.75\%$ by weight; 0.85 when Bi is 0.75% by weight $\leq Bi<1.5\%$ by weight; and 1 when Bi is 1.5% by weight $\leq Bi\leq 4.0\%$ by weight, and b is 1 when the apparent content of zinc (Zn) is not less than 37% and less than 41%; and 0.75 when the apparent content of Zn is not less than 41% and not more than 45%.

In a further preferred embodiment of the present invention, the relationship between the addition amount of Al and the corresponding B and Si contents is as follows.

In the following description, y and x represent the content of B, % by weight, and the content of Si, % by weight, respectively.

When 0.1% by weight $\leq Al<0.3\%$ by weight, (1) $0\leq y\leq 0.3$, $0\leq x\leq 2.0$, and $y\geq -0.14x+0.0175ab$, when 0.3% by weight $\leq Al<1.0\%$ by weight, (1) $-0.14x+0.0175ab\leq y\leq 0.3$ when $0\leq x\leq 0.1178ab$, (2) $0.001ab\leq y\leq 0.3$ when $0.1178ab<x\leq 0.3ab$, (3) $-0.00375x+0.002125ab\leq y\leq 0.3$ when $0.3ab<x\leq 0.5ab$, (4) $0.00025ab\leq y\leq 0.3$ when $0.5ab<x\leq 1.5ab$, and (5) $0.0025x-0.0035(2-ab)\leq y\leq 0.3$ when $1.5ab<x\leq 2.0$, and when 1.0% by weight $\leq Al\leq 2.0\%$ by weight, (1) $0.00575ab\leq y\leq 0.3$ when $0.05ab\leq x\leq 0.3ab$, (2) $-0.01375x+0.009875ab\leq y\leq 0.3$ when $0.3ab<x\leq 0.5ab$, (3) $-0.0055x+0.00575ab\leq y\leq 0.3$ when $0.5ab<x\leq 1.0ab$, (4) $0.001x-0.00075(2-ab)\leq y\leq 0.3$ when $1.0ab<x\leq 1.5ab$, and (5) $0.00075ab\leq y\leq 0.3$ when $1.5ab<x\leq 2.0$, wherein x, y, a, and b are as defined above.

Further, in still another embodiment of the present invention, Sn may be added to improve the corrosion resistance. In the brass according to the present invention, there is a possibility that Sn is also likely to increase the susceptibility of the material to casting cracking. In order to more effectively improve the corrosion resistance by the addition of Sn, preferably, not less than 0.3% by weight of Sn is added. On the other hand, preferably, the addition of an excessive amount of Sn is avoided from the viewpoint of casting cracking. The upper limit of the addition amount of Sn is preferably 3.0% by weight.

In a further preferred embodiment of the present invention, the relationship between the addition amount of Sn and the corresponding B and Si contents is as follows.

In the following description, y and x represent the content of B, % by weight, and the content of Si, % by weight, respectively.

When 0.1% by weight $\leq Sn<0.3\%$ by weight, (1) $-0.16x+0.02ab<y\leq 0.3$ when $0\leq x\leq 0.125ab$, (2) $0<y\leq 0.3$ when $0.125ab<x\leq 0.4ab$, and (3) $0\leq y\leq 0.3$ when $0.4ab<x\leq 2.0$, when 0.3% by weight $\leq Sn<1.5\%$ by weight, (1) $-0.08x+0.02ab<y\leq 0.3$ when $0\leq x\leq 0.25ab$, (2) $0<y\leq 0.3$ when $0.25ab<x\leq 1.25ab$, (3) $0\leq y\leq 0.3$ when $1.25ab<x\leq 1.75ab$, and (4) $0.002x-0.0035(2-ab)<y\leq 0.3$ when $1.75ab<x\leq 2.0$, and when 1.5% by weight $\leq Sn\leq 3.0\%$ by weight, (1) $0.025ab<y\leq 0.3$ when $0\leq x\leq 0.1ab$, (2) $-0.105x+0.0355ab<y\leq 0.3$ when $0.1ab<x\leq 0.3ab$, (3) $0.004ab<y\leq 0.3$ when $0.3ab<x\leq 0.5ab$, (4) $0.007x+0.0005ab<y\leq 0.3$ when $0.5ab<x\leq 1.0ab$, and (5) $0.045x-0.0375(2-ab)<y\leq 0.3$ when $1.0ab<x\leq 2.0$, wherein a is 0.2 when Bi is 0.3% by weight ≤Bi<0.75% by weight; 0.85 when Bi is 0.75% by weight ≤Bi<1.5% by weight; and 1 when Bi is 1.5% by weight ≤Bi≤4.0% by weight, and b is 1 when the apparent content of zinc (Zn) is not less than 37% and less than 41%; and 0.75 when the apparent content of Zn is not less than 41% and not more than 45%.

In a further preferred embodiment of the present invention, the relationship between the addition amount of Sn and the corresponding B and Si contents is as follows.

In the following description, y and x represent the content of B, % by weight, and the content of Si, % by weight, respectively.

When 0.1% by weight ≤Sn<0.3% by weight, (1) $-0.1925x+0.025ab \le y \le 0.3$ when $0 \le x \le 0.1246ab$, (2) $0.001ab \le y \le 0.3$ when $0.1246ab < x \le 0.3ab$, (3) $-0.01x+0.004ab \le y \le 0.3$ when $0.3ab < x \le 0.4ab$, and (4) $0 \le y \le 0.3$ when $0.4ab < x \le 2.0$, when 0.3% by weight ≤Sn<1.5% by weight, (1) $-0.1375x+0.025ab \le y \le 0.3$ when $0 \le x \le 0.1ab$, (2) $-0.055x+0.01675ab \le y \le 0.3$ when $0.1ab < x \le 0.286ab$, (3) $0.001ab \le y \le 0.3$ when $0.286ab < x \le 0.3ab$, (4) $-0.00375x+0.002125ab \le y \le 0.3$ when $0.3ab < x \le 0.5ab$, (5) $0.00025ab \le y \le 0.3$ when $0.5ab < x \le 1.0ab$, (6) $-0.001x+0.00125ab \le y \le 0.3$ when $1.0ab < x \le 1.25ab$, (7) $0 \le y \le 0.3$ when $1.25ab < x \le 1.75ab$, and (8) $0.003x-0.00525(2-ab) \le y \le 0.3$ when $1.75ab < x \le 2.0$, and when 1.5% by weight ≤Sn≤3.0% by weight, (1) $0.0275ab \le y \le 0.3$ when $0 \le x \le 0.1ab$, (2) $-0.075x+0.035ab \le y \le 0.3$ when $0.1ab < x \le 0.2ab$, (3) $-0.1425x+0.0485ab \le y \le 0.3$ when $0.2ab < x \le 0.3ab$, (4) $0.00575ab \le y \le 0.3$ when $0.3ab < x \le 0.5ab$ (5) $0.011x+0.00025ab \le y \le 0.3$ when $0.5ab < x \le 1.0ab$, and (6) $0.075x-0.06375(2-ab) \le y \le 0.3$ when $1.0ab < x \le 1.25$, wherein x, y, a, and b are as defined above.

When Ni, Al, and Sn coexist, depending upon the addition amount of each of the coexisting elements, setting is carried out so that all the above-defined ranges are simultaneously met. Specifically, according to another aspect of the present invention, there is provided a brass having a crystal texture in which the total proportion of α phase and β phase is not less than 85%, and consisting of:

not less than 55% by weight and not more than 75% by weight of copper (Cu), not less than 0.3% by weight and not more than 4.0% by weight of bismuth (Bi), and boron (B) and silicon (Si) and, further, at least two constituents selected from the group consisting of not less than 0.1% by weight and not more than 2.0% by weight of nickel (Ni), not less than 0.1% by weight and not more than 2.0% by weight of aluminum (Al), and not less than 0.1% by weight and not more than 3.0% by weight of tin (Sn), the balance consisting of Zn and unavoidable impurities, the content of B and the content of Si being y % by weight and x % by weight, respectively, which simultaneously satisfy at least two relational expressions specified in claims 2 to 10 in relation with the content of each of at least two elements selected from the group consisting of Ni, Al, and Sn.

In the brass according to the present invention, the addition of Mn to improve the strength of the material results in the formation of an intermetallic compound between Mn and Si which consumes Si. Accordingly, in this case, there is a possibility that casting cracking takes place. When Mn is not used, the Mn content is less than 0.3% by weight from the viewpoint of suppressing the influence of Mn on the casting cracking. On the other hand, when effective utilization of an improvement in strength by the addition of Mn is contemplated, the addition amount of Si may be satisfactorily increased. Specifically, when the addition amount of Mn is not less than 0.3% by weight, the influence of the addition of Mn on casting cracking can be suppressed by satisfying the above-defined content range and 0.7% by weight <Si≤2.0% by weight. The addition of an excessive amount of Mn increases the amount of the intermetallic compound and lowers the machinability. Accordingly, the upper limit of the Mn content is 4.00% by weight.

In the brass according to the present invention, other components, for example, Sb and P which, even when added in a very small amount, can contribute to an improvement in corrosion resistance, and Fe which can improve, as a refining agent, casting cracking resistance and can be expected to improve strength, can be selected and added as an additive element according to the purposes. These components sometimes affect the castability depending upon the addition amount. This influence, however, can be suppressed by regulating the contents of B and Si. Specifically, in a system which causes casting cracking, the influence of the above elements on the casting cracking can be suppressed by further increasing the content of B in the above-defined range, further increasing the content of Si in the above-defined range, or increasing both the B content and the Si content in the above-defined ranges. In a preferred embodiment of the present invention, the brass according to the present invention may contain one or more elements selected from the group consisting of Sb, P, As, Mg, Se, Te, Fe, Co, Zr, Cr, and Ti, preferably in an amount of 0.01 to 2% by weight. In another preferred embodiment of the present invention, one or more elements selected from the group consisting of Sb, P, As, and Mg may be contained from the viewpoint of improving the corrosion resistance. Preferably, the contents of Sb, P, and As are not more than 0.2% by weight, and the content of Mg is not more than 1% by weight. In still another preferred embodiment of the present invention, Se or Te is contained from the viewpoint of improving the machinability preferably in an amount of not more than 1% by weight. In a further preferred embodiment of the present invention, one or more elements selected from the group consisting of Fe, Co, Zr, Cr, and Ti may be contained from the viewpoint of improving the strength. Preferably, the contents of Fe and Co are not more than 1% by weight, and the contents of the other elements are not more than 0.5% by weight.

Use

The brass according to the present invention is free from Pb, but on the other hand, the machinability, castability, and mechanical properties of the brass are favorably comparable with those of Pb-containing brass. Thus, the brass is preferably used in faucet metal fitting materials. Specifically, the brass according to the present invention is preferably used as a material for water supply metal fittings, drainage metal fittings, valves and the like.

Production Process

Molded products may be produced using the brass according to the present invention as a material by any of mold casting and sand casting by virtue of good castability of the brass. However, the effect of the good castability can be more clearly enjoyed in the mold casting. Further, the brass according to the present invention has good machinability and thus can be machined after casting. Furthermore, after continuous casting, the brass according to the present invention may be extruded into bars for machining and bars for forging, or alternatively may be drawn into wire rods.

EXAMPLES

The following Examples further illustrate the present invention. However, it should be noted that the present invention is not limited to these Examples.

Evaluation Tests

Evaluation tests conducted in the following Examples will be described in detail.

(1) Casting Cracking Resistance Test

The casting cracking resistance was evaluated by a both end restriction test. In this test, a mold 1 having a shape shown in FIG. 1 was used. In FIG. 1, a heat insulating material 2 was provided at the central part so that the central part was cooled later than both end restriction parts 3. The restriction end distance (2L) was 100 mm, and the length (2l) of the heat insulating material was 70 mm.

In the test, in such a state that the restriction parts were rapidly quenched and the solidified restriction parts located at both ends were restricted, the solidification of the central part was allowed to proceed. In this case, whether or not cracking took place at the central part of a test piece as the final solidified part by the resultant solidification shrinkage stress was examined.

The casting cracking resistance was evaluated as ◎ when cracking did not take place; as ○ when cracking partially took place but the cracking was not such a level that the test piece was broken; and as x when cracking took place resulting in breaking of the test piece.

(2) Machinability Test

A cast ingot having a diameter of 35 mm and a length of 100 mm was produced by metal mold casting. The outside diameter part was turned to evaluate the machinability of the cast ingot. Specifically, the machinability was evaluated in terms of cutting resistance index against type 3 brass casting (JIS CAC203). The machining was carried out under conditions of peripheral speed 80 to 175 m/min, feed speed 0.07 to 0.14 mm/rev., and depth of cut 0.25 to 1 mm, and the cutting resistance index was calculated by the following equation:

$$\text{Cutting resistance index}(\%)=\text{Cutting resistance for CAC203}/\text{Cutting resistance for test material}\times 100.$$

The machinability was evaluated as ◎ when the cutting resistance index was not less than 70%; as ○ when the cutting resistance index was not less than 50% and less than 70%; and as x when the cutting resistance index was less than 50%.

(3) Mechanical Property Test

A cast ingot having a diameter of 35 mm and a length of 100 mm was produced by metal mold casting and was machined into a No. 14A test piece specified in JIS Z 2201, and the test piece was subjected to a tensile test. Specifically, 0.2% proof stress, tensile strength, and breaking elongation of the test piece were measured, and the results were evaluated. In this case, a 0.2% proof stress of not less than 100 N/mm$^2$, a tensile strength of not less than 245 N/mm$^2$, and a breaking elongation of not less than 20% were used as reference values. The mechanical properties of the cast ingot were evaluated as ◎ when all the above three requirements were satisfied; as ○ when two of the above three requirements were satisfied; and as x when only one or none of the above three requirements was satisfied.

(4) Corrosion Resistance Test

A cast ingot having a diameter of 35 mm and a length of 100 mm was produced by metal mold casting. This cast ingot was provided as a test piece and was tested according to the technical standards JBMA T-303-2007 established by Japan Copper and Brass Association.

The corrosion resistance was evaluated as ◎ when the maximum erosion depth was not more than 150 μm; as ○ when the maximum erosion depth was more than 150 μm and not more than 300 μm; and as x when the maximum erosion depth was more than 300 μm.

(5) Measurement of Proportion of Crystal Phases

A photograph of a crystal texture was taken with an optical microscope and was subjected to image processing to determine the proportion of the areas of α phase and β phase.

Examples 1 to 515

Brasses having chemical compositions shown in the following tables were produced by casting. Specifically, electrolytic Cu (copper), electrolytic Zn (zinc), electrolytic Bi (bismuth), electrolytic Pb (lead), electrolytic Sn (tin), Cu-30% Ni mother alloy, electrolytic Al (aluminum), Cu-15% Si mother alloy, Cu-2% B mother alloy, Cu-30% Mn mother alloy, Cu-10% Cr mother alloy, Cu-15% P mother alloy, Cu-10% Fe mother alloy and the like were provided as raw materials, were melted in a high frequency melting furnace while regulating the chemical composition of the melt. The melt was first cast into a mold for a both end restriction test to evaluate casting cracking resistance.

Subsequently, the melt was cast into a cylindrical mold to produce a cast ingot having a diameter of 35 mm and a length of 100 mm. The cast ingot was used as a sample for the evaluation of machinability, mechanical properties, and corrosion resistance, and the measurement of the proportion of crystal phases.

The results were as shown in the following tables.

TABLE 1

| No. | Cu | Zn | Bi | Pb | Si | B | Al | Sn | Ni | Zinc equivalent | Casting cracking resistance | Machinability | Mechanical properties |
|---|---|---|---|---|---|---|---|---|---|---|---|---|---|
| 1 | 60.60 | 38.40 | 1.0 | 0 | 0 | 0 | 0 | 0 | 0 | 39.2 | X | ◎ | ◎ |
| 2 | 60.20 | 37.80 | 2.0 | 0 | 0 | 0 | 0 | 0 | 0 | 39.3 | X | ◎ | ◎ |
| 3 | 59.80 | 37.20 | 3.0 | 0 | 0 | 0 | 0 | 0 | 0 | 39.5 | X | ◎ | ◎ |
| 4 | 61.00 | 37.00 | 0 | 2.0 | 0 | 0 | 0 | 0 | 0 | 39.0 | ◎ | ◎ | ◎ |

TABLE 2

| No. | Cu | Zn | Bi | Si | B | Al | Sn | Ni | Zinc equivalent | Casting cracking resistance | Machin-ability | Mechanical properties | Phase proportion α | Phase proportion β | Phase proportion α + β |
|---|---|---|---|---|---|---|---|---|---|---|---|---|---|---|---|
| 5 | 80.00 | 13.24 | 2.0 | 2.00 | 0.0075 | 2.00 | 0.70 | 0.05 | 37.4 | X | ○ | ○ | 69 | 14 | 83 |
| 6 | 75.00 | 19.39 | 2.0 | 1.50 | 0.0075 | 2.00 | 0.05 | 0.05 | 38.8 | ◎ | ○ | ○ | 64 | 24 | 88 |
| 7 | 70.00 | 25.49 | 2.0 | 1.40 | 0.0075 | 1.00 | 0.05 | 0.05 | 40.0 | ◎ | ◎ | ◎ | 58 | 33 | 91 |
| 8 | 65.00 | 31.39 | 2.0 | 1.00 | 0.0075 | 0.50 | 0.05 | 0.05 | 41.2 | ◎ | ◎ | ◎ | 53 | 45 | 98 |

TABLE 2-continued

| No. | Cu | Zn | Bi | Si | B | Al | Sn | Ni | Zinc equivalent | Casting cracking resistance | Machin-ability | Mechanical properties | Phase proportion α | Phase proportion β | Phase proportion α + β |
|---|---|---|---|---|---|---|---|---|---|---|---|---|---|---|---|
| 9 | 60.00 | 37.19 | 2.0 | 0.60 | 0.0150 | 0.10 | 0.05 | 0.05 | 42.9 | ◎ | ◎ | ◎ | 44 | 54 | 98 |
| 10 | 55.00 | 42.87 | 2.0 | 0 | 0.0300 | 0 | 0.05 | 0.05 | 44.5 | ◎ | ◎ | ○ | 31 | 67 | 98 |

TABLE 3

| No. | Cu | Zn | Bi | Si | B | Al | Sn | Ni | Zinc equivalent | Casting cracking resistance | Machinability | Mechanical properties |
|---|---|---|---|---|---|---|---|---|---|---|---|---|
| 11 | 62.00 | 36.40 | 1.0 | 0.50 | 0.0050 | 0 | 0.50 | 0.50 | 40.4 | ◎ | ◎ | ◎ |
| 12 | 62.00 | 36.39 | 1.0 | 0.50 | 0.0100 | 0 | 0.50 | 0.50 | 40.4 | ◎ | ◎ | ◎ |
| 13 | 62.00 | 36.37 | 1.0 | 0.50 | 0.0300 | 0 | 0.50 | 0.50 | 40.4 | ◎ | ◎ | ◎ |
| 14 | 62.00 | 36.30 | 1.0 | 0.50 | 0.1000 | 0 | 0.50 | 0.50 | 40.4 | ◎ | ◎ | ○ |
| 15 | 62.00 | 36.10 | 1.0 | 0.50 | 0.3000 | 0 | 0.50 | 0.50 | 40.4 | ◎ | ○ | ○ |
| 16 | 62.00 | 35.90 | 1.0 | 0.50 | 0.5000 | 0 | 0.50 | 0.50 | 40.4 | ◎ | X | ○ |

TABLE 4

| No. | Cu | Zn | Bi | Si | B | Al | Sn | Ni | Zinc equivalent | Casting cracking resistance | Machinability | Mechanical properties |
|---|---|---|---|---|---|---|---|---|---|---|---|---|
| 17 | 59.80 | 39.60 | 0.50 | 0 | 0 | 0 | 0.05 | 0.05 | 40.0 | X | ○ | ◎ |
| 18 | 59.80 | 39.60 | 0.50 | 0 | 0.0020 | 0 | 0.05 | 0.05 | 40.0 | X | ○ | ◎ |
| 19 | 59.80 | 39.60 | 0.50 | 0 | 0.0040 | 0 | 0.05 | 0.05 | 40.0 | ◎ | ○ | ◎ |
| 20 | 59.80 | 39.59 | 0.50 | 0 | 0.0075 | 0 | 0.05 | 0.05 | 40.0 | ◎ | ○ | ◎ |
| 21 | 59.80 | 39.59 | 0.50 | 0 | 0.0150 | 0 | 0.05 | 0.05 | 40.0 | ◎ | ○ | ◎ |
| 22 | 59.90 | 39.48 | 0.50 | 0.02 | 0 | 0 | 0.05 | 0.05 | 40.0 | X | ○ | ◎ |
| 23 | 60.10 | 39.25 | 0.50 | 0.05 | 0 | 0 | 0.05 | 0.05 | 40.0 | ◎ | ○ | ◎ |
| 24 | 60.40 | 38.90 | 0.50 | 0.10 | 0 | 0 | 0.05 | 0.05 | 40.0 | ◎ | ○ | ◎ |
| 25 | 60.50 | 38.54 | 0.50 | 0.10 | 0.0075 | 0 | 0.30 | 0.05 | 40.0 | ◎ | ○ | ◎ |
| 26 | 60.50 | 38.54 | 0.50 | 0.10 | 0.0150 | 0 | 0.30 | 0.05 | 40.0 | ◎ | ○ | ◎ |
| 27 | 60.90 | 38.30 | 0.50 | 0.20 | 0 | 0 | 0.05 | 0.05 | 40.0 | ◎ | ○ | ◎ |
| 28 | 60.90 | 38.29 | 0.50 | 0.20 | 0.0075 | 0 | 0.05 | 0.05 | 40.0 | ◎ | ○ | ◎ |
| 29 | 60.90 | 38.29 | 0.50 | 0.20 | 0.0150 | 0 | 0.05 | 0.05 | 40.0 | ◎ | ○ | ◎ |
| 30 | 61.50 | 37.60 | 0.50 | 0.30 | 0 | 0 | 0.05 | 0.05 | 40.0 | ◎ | ○ | ◎ |
| 31 | 61.50 | 37.59 | 0.50 | 0.30 | 0.0075 | 0 | 0.05 | 0.05 | 40.0 | ◎ | ○ | ◎ |
| 32 | 61.50 | 37.59 | 0.50 | 0.30 | 0.0150 | 0 | 0.05 | 0.05 | 40.0 | ◎ | ○ | ◎ |
| 33 | 59.70 | 39.19 | 1.00 | 0 | 0.0075 | 0 | 0.05 | 0.05 | 40.0 | X | ◎ | ◎ |
| 34 | 59.70 | 39.19 | 1.00 | 0 | 0.0110 | 0 | 0.05 | 0.05 | 40.0 | X | ◎ | ◎ |
| 35 | 59.70 | 39.19 | 1.00 | 0 | 0.0125 | 0 | 0.05 | 0.05 | 40.0 | X | ◎ | ◎ |
| 36 | 59.70 | 39.19 | 1.00 | 0 | 0.0150 | 0 | 0.05 | 0.05 | 40.0 | ◎ | ◎ | ◎ |
| 37 | 59.70 | 39.18 | 1.00 | 0 | 0.0200 | 0 | 0.05 | 0.05 | 40.0 | ◎ | ◎ | ◎ |
| 38 | 59.70 | 39.17 | 1.00 | 0 | 0.0300 | 0 | 0.05 | 0.05 | 40.0 | ◎ | ◎ | ◎ |
| 39 | 60.00 | 38.85 | 1.00 | 0.05 | 0 | 0 | 0.05 | 0.05 | 40.0 | X | ◎ | ◎ |
| 40 | 60.00 | 38.83 | 1.00 | 0.07 | 0 | 0 | 0.05 | 0.05 | 40.1 | X | ◎ | ◎ |
| 41 | 60.30 | 38.50 | 1.00 | 0.10 | 0 | 0 | 0.05 | 0.05 | 40.0 | ◎ | ◎ | ◎ |
| 42 | 60.30 | 38.49 | 1.00 | 0.10 | 0.0075 | 0 | 0.05 | 0.05 | 40.0 | ◎ | ◎ | ◎ |
| 43 | 60.30 | 38.49 | 1.00 | 0.10 | 0.0150 | 0 | 0.05 | 0.05 | 40.0 | ◎ | ◎ | ◎ |
| 44 | 60.80 | 37.90 | 1.00 | 0.20 | 0 | 0 | 0.05 | 0.05 | 40.0 | ◎ | ◎ | ◎ |
| 45 | 60.80 | 37.89 | 1.00 | 0.20 | 0.0075 | 0 | 0.05 | 0.05 | 40.0 | ◎ | ◎ | ◎ |
| 46 | 60.80 | 37.89 | 1.00 | 0.20 | 0.0150 | 0 | 0.05 | 0.05 | 40.0 | ◎ | ◎ | ◎ |
| 47 | 61.30 | 37.30 | 1.00 | 0.30 | 0 | 0 | 0.05 | 0.05 | 40.0 | ◎ | ◎ | ◎ |

TABLE 5

| No. | Cu | Zn | Bi | Si | B | Al | Sn | Ni | Zinc equivalent | Casting cracking resistance | Machinability | Mechanical properties |
|---|---|---|---|---|---|---|---|---|---|---|---|---|
| 48 | 61.30 | 37.29 | 1.00 | 0.30 | 0.0075 | 0 | 0.05 | 0.05 | 40.0 | ◎ | ◎ | ◎ |
| 49 | 61.30 | 37.29 | 1.00 | 0.30 | 0.0150 | 0 | 0.05 | 0.05 | 40.0 | ◎ | ◎ | ◎ |
| 50 | 59.50 | 38.39 | 2.00 | 0 | 0.0075 | 0 | 0.05 | 0.05 | 40.0 | X | ◎ | ◎ |
| 51 | 59.50 | 38.39 | 2.00 | 0 | 0.0150 | 0 | 0.05 | 0.05 | 40.0 | X | ◎ | ◎ |
| 52 | 59.50 | 38.38 | 2.00 | 0 | 0.0200 | 0 | 0.05 | 0.05 | 40.0 | ◎ | ◎ | ◎ |
| 53 | 59.50 | 38.38 | 2.00 | 0 | 0.0250 | 0 | 0.05 | 0.05 | 40.0 | ◎ | ◎ | ◎ |
| 54 | 59.50 | 38.37 | 2.00 | 0 | 0.0300 | 0 | 0.05 | 0.05 | 40.0 | ◎ | ◎ | ◎ |
| 55 | 60.00 | 37.80 | 2.00 | 0.10 | 0 | 0 | 0.05 | 0.05 | 40.0 | X | ◎ | ◎ |
| 56 | 60.00 | 37.79 | 2.00 | 0.10 | 0.0075 | 0 | 0.05 | 0.05 | 40.0 | ◎ | ◎ | ◎ |

TABLE 5-continued

| No. | Cu | Zn | Bi | Si | B | Al | Sn | Ni | Zinc equivalent | Casting cracking resistance | Machinability | Mechanical properties |
|---|---|---|---|---|---|---|---|---|---|---|---|---|
| 57 | 60.00 | 37.79 | 2.00 | 0.10 | 0.0150 | 0 | 0.05 | 0.05 | 40.0 | ◎ | ◎ | ◎ |
| 58 | 60.30 | 37.45 | 2.00 | 0.15 | 0 | 0 | 0.05 | 0.05 | 40.0 | ◎ | ◎ | ◎ |
| 59 | 60.60 | 37.10 | 2.00 | 0.20 | 0 | 0 | 0.05 | 0.05 | 40.0 | ◎ | ◎ | ◎ |
| 60 | 60.60 | 37.09 | 2.00 | 0.20 | 0.0075 | 0 | 0.05 | 0.05 | 40.0 | ◎ | ◎ | ◎ |
| 61 | 60.60 | 37.09 | 2.00 | 0.20 | 0.0150 | 0 | 0.05 | 0.05 | 40.0 | ◎ | ◎ | ◎ |
| 62 | 61.10 | 36.50 | 2.00 | 0.30 | 0 | 0 | 0.05 | 0.05 | 40.0 | ◎ | ◎ | ◎ |
| 63 | 61.10 | 36.50 | 2.00 | 0.30 | 0.0010 | 0 | 0.05 | 0.05 | 40.0 | ◎ | ◎ | ◎ |
| 64 | 61.10 | 36.50 | 2.00 | 0.30 | 0.0020 | 0 | 0.05 | 0.05 | 40.0 | ◎ | ◎ | ◎ |
| 65 | 61.10 | 36.50 | 2.00 | 0.30 | 0.0040 | 0 | 0.05 | 0.05 | 40.0 | ◎ | ◎ | ◎ |
| 66 | 61.10 | 36.49 | 2.00 | 0.30 | 0.0075 | 0 | 0.05 | 0.05 | 40.0 | ◎ | ◎ | ◎ |
| 67 | 61.10 | 36.49 | 2.00 | 0.30 | 0.0150 | 0 | 0.05 | 0.05 | 40.0 | ◎ | ◎ | ◎ |
| 68 | 61.10 | 36.47 | 2.00 | 0.30 | 0.0300 | 0 | 0.05 | 0.05 | 40.0 | ◎ | ◎ | ◎ |
| 69 | 62.20 | 35.20 | 2.00 | 0.50 | 0 | 0 | 0.05 | 0.05 | 40.0 | ◎ | ◎ | ◎ |
| 70 | 64.90 | 32.00 | 2.00 | 1.00 | 0 | 0 | 0.05 | 0.05 | 40.0 | ◎ | ◎ | ◎ |
| 71 | 67.60 | 28.80 | 2.00 | 1.50 | 0 | 0 | 0.05 | 0.05 | 40.0 | ◎ | ◎ | ◎ |
| 72 | 70.30 | 25.60 | 2.00 | 2.00 | 0 | 0 | 0.05 | 0.05 | 40.0 | ◎ | ◎ | ◎ |
| 73 | 59.20 | 37.69 | 3.00 | 0 | 0.0075 | 0 | 0.05 | 0.05 | 40.0 | X | ◎ | ◎ |
| 74 | 59.20 | 37.69 | 3.00 | 0 | 0.0150 | 0 | 0.05 | 0.05 | 40.0 | X | ◎ | ◎ |
| 75 | 59.20 | 37.68 | 3.00 | 0 | 0.0200 | 0 | 0.05 | 0.05 | 40.0 | ◎ | ◎ | ◎ |
| 76 | 59.20 | 37.67 | 3.00 | 0 | 0.0300 | 0 | 0.05 | 0.05 | 40.0 | ◎ | ◎ | ◎ |
| 77 | 59.80 | 37.00 | 3.00 | 0.10 | 0 | 0 | 0.05 | 0.05 | 40.0 | X | ◎ | ◎ |

TABLE 6

| No. | Cu | Zn | Bi | Si | B | Al | Sn | Ni | Zinc equivalent | Casting cracking resistance | Machinability | Mechanical properties |
|---|---|---|---|---|---|---|---|---|---|---|---|---|
| 78 | 59.80 | 36.99 | 3.00 | 0.10 | 0.0075 | 0 | 0.05 | 0.05 | 40.0 | ◎ | ◎ | ◎ |
| 79 | 59.80 | 36.99 | 3.00 | 0.10 | 0.0150 | 0 | 0.05 | 0.05 | 40.0 | ◎ | ◎ | ◎ |
| 80 | 60.10 | 36.65 | 3.00 | 0.15 | 0 | 0 | 0.05 | 0.05 | 40.0 | ◎ | ◎ | ◎ |
| 81 | 60.30 | 36.40 | 3.00 | 0.20 | 0 | 0 | 0.05 | 0.05 | 40.0 | ◎ | ◎ | ◎ |
| 82 | 60.30 | 36.39 | 3.00 | 0.20 | 0.0075 | 0 | 0.05 | 0.05 | 40.0 | ◎ | ◎ | ◎ |
| 83 | 60.30 | 36.39 | 3.00 | 0.20 | 0.0150 | 0 | 0.05 | 0.05 | 40.0 | ◎ | ◎ | ◎ |
| 84 | 60.90 | 35.70 | 3.00 | 0.30 | 0 | 0 | 0.05 | 0.05 | 40.0 | ◎ | ◎ | ◎ |
| 85 | 60.90 | 35.69 | 3.00 | 0.30 | 0.0075 | 0 | 0.05 | 0.05 | 40.0 | ◎ | ◎ | ◎ |
| 86 | 60.90 | 35.69 | 3.00 | 0.30 | 0.0150 | 0 | 0.05 | 0.05 | 40.0 | ◎ | ◎ | ◎ |
| 87 | 59.00 | 36.89 | 4.00 | 0 | 0.0075 | 0 | 0.05 | 0.05 | 40.0 | X | ◎ | ◎ |
| 88 | 59.00 | 36.89 | 4.00 | 0 | 0.0150 | 0 | 0.05 | 0.05 | 40.0 | X | ◎ | ◎ |
| 89 | 59.00 | 36.88 | 4.00 | 0 | 0.0200 | 0 | 0.05 | 0.05 | 40.0 | ◎ | ◎ | ◎ |
| 90 | 59.00 | 36.87 | 4.00 | 0 | 0.0300 | 0 | 0.05 | 0.05 | 40.0 | ◎ | ◎ | ◎ |
| 91 | 59.50 | 36.30 | 4.00 | 0.10 | 0 | 0 | 0.05 | 0.05 | 40.0 | X | ◎ | ◎ |
| 92 | 59.50 | 36.29 | 4.00 | 0.10 | 0.0075 | 0 | 0.05 | 0.05 | 40.0 | ◎ | ◎ | ◎ |
| 93 | 59.50 | 36.29 | 4.00 | 0.10 | 0.0150 | 0 | 0.05 | 0.05 | 40.0 | ◎ | ◎ | ◎ |
| 94 | 59.80 | 35.95 | 4.00 | 0.15 | 0 | 0 | 0.05 | 0.05 | 40.0 | ◎ | ◎ | ◎ |
| 95 | 60.10 | 35.60 | 4.00 | 0.20 | 0 | 0 | 0.05 | 0.05 | 40.0 | ◎ | ◎ | ◎ |
| 96 | 60.10 | 35.59 | 4.00 | 0.20 | 0.0075 | 0 | 0.05 | 0.05 | 40.0 | ◎ | ◎ | ◎ |
| 97 | 60.10 | 35.59 | 4.00 | 0.20 | 0.0150 | 0 | 0.05 | 0.05 | 40.0 | ◎ | ◎ | ◎ |
| 98 | 60.60 | 35.00 | 4.00 | 0.30 | 0 | 0 | 0.05 | 0.05 | 40.0 | ◎ | ◎ | ◎ |
| 99 | 60.60 | 34.99 | 4.00 | 0.30 | 0.0075 | 0 | 0.05 | 0.05 | 40.0 | ◎ | ◎ | ◎ |
| 100 | 60.60 | 34.99 | 4.00 | 0.30 | 0.0150 | 0 | 0.05 | 0.05 | 40.0 | ◎ | ◎ | ◎ |

TABLE 7

| No. | Cu | Zn | Bi | Si | B | Al | Sn | Ni | Zinc equivalent | Casting cracking resistance | Machinability | Mechanical properties |
|---|---|---|---|---|---|---|---|---|---|---|---|---|
| 101 | 65.00 | 32.57 | 2.0 | 0.30 | 0.0300 | 0 | 0.05 | 0.05 | 36.2 | X | ◎ | ◎ |
| 102 | 64.00 | 33.57 | 2.0 | 0.30 | 0.0300 | 0 | 0.05 | 0.05 | 37.2 | ◎ | ◎ | ◎ |
| 103 | 63.00 | 34.57 | 2.0 | 0.30 | 0.0300 | 0 | 0.05 | 0.05 | 38.1 | ◎ | ◎ | ◎ |
| 104 | 61.00 | 36.57 | 2.0 | 0.30 | 0.0300 | 0 | 0.05 | 0.05 | 40.1 | ◎ | ◎ | ◎ |
| 105 | 59.00 | 38.57 | 2.0 | 0.30 | 0.0300 | 0 | 0.05 | 0.05 | 42.1 | ◎ | ◎ | ◎ |
| 106 | 58.00 | 39.57 | 2.0 | 0.30 | 0.0300 | 0 | 0.05 | 0.05 | 43.0 | ◎ | ◎ | ○ |
| 107 | 56.00 | 41.57 | 2.0 | 0.30 | 0.0300 | 0 | 0.05 | 0.05 | 45.0 | ◎ | ◎ | ○ |
| 108 | 61.50 | 36.39 | 2.00 | 0 | 0.0075 | 0 | 0.05 | 0.05 | 38.0 | X | ◎ | ◎ |
| 109 | 61.50 | 36.39 | 2.00 | 0 | 0.0150 | 0 | 0.30 | 0.05 | 38.0 | X | ◎ | ◎ |

TABLE 7-continued

| No. | Cu | Zn | Bi | Si | B | Al | Sn | Ni | Zinc equivalent | Casting cracking resistance | Machinability | Mechanical properties |
|---|---|---|---|---|---|---|---|---|---|---|---|---|
| 110 | 61.50 | 36.38 | 2.00 | 0 | 0.0200 | 0 | 0.05 | 0.05 | 38.0 | ◎ | ◎ | ◎ |
| 111 | 61.50 | 36.38 | 2.00 | 0 | 0.0250 | 0 | 0.05 | 0.05 | 38.0 | ◎ | ◎ | ◎ |
| 112 | 61.50 | 36.37 | 2.00 | 0 | 0.0300 | 0 | 0.05 | 0.05 | 38.0 | ◎ | ◎ | ◎ |
| 113 | 62.00 | 35.80 | 2.00 | 0.10 | 0 | 0 | 0.05 | 0.05 | 38.0 | X | ◎ | ◎ |
| 114 | 62.00 | 35.79 | 2.00 | 0.10 | 0.0075 | 0 | 0.05 | 0.05 | 38.0 | ◎ | ◎ | ◎ |
| 115 | 62.00 | 35.79 | 2.00 | 0.10 | 0.0150 | 0 | 0.05 | 0.05 | 38.0 | ◎ | ◎ | ◎ |
| 116 | 62.30 | 35.45 | 2.00 | 0.15 | 0 | 0 | 0.05 | 0.05 | 38.0 | ◎ | ◎ | ◎ |
| 117 | 62.60 | 35.10 | 2.00 | 0.20 | 0 | 0 | 0.05 | 0.05 | 38.0 | ◎ | ◎ | ◎ |
| 118 | 62.60 | 35.09 | 2.00 | 0.20 | 0.0075 | 0 | 0.05 | 0.05 | 38.0 | ◎ | ◎ | ◎ |
| 119 | 62.60 | 35.09 | 2.00 | 0.20 | 0.0150 | 0 | 0.05 | 0.05 | 38.0 | ◎ | ◎ | ◎ |
| 120 | 57.50 | 40.39 | 2.00 | 0 | 0.0075 | 0 | 0.05 | 0.05 | 42.0 | X | ◎ | ◎ |
| 121 | 57.50 | 40.39 | 2.00 | 0 | 0.0110 | 0 | 0.05 | 0.05 | 42.0 | X | ◎ | ◎ |
| 122 | 57.50 | 40.39 | 2.00 | 0 | 0.0125 | 0 | 0.05 | 0.05 | 42.0 | ◎ | ◎ | ◎ |
| 123 | 57.50 | 40.39 | 2.00 | 0 | 0.0150 | 0 | 0.05 | 0.05 | 42.0 | ◎ | ◎ | ◎ |
| 124 | 57.50 | 40.38 | 2.00 | 0 | 0.0200 | 0 | 0.05 | 0.05 | 42.0 | ◎ | ◎ | ◎ |
| 125 | 57.50 | 40.37 | 2.00 | 0 | 0.0300 | 0 | 0.05 | 0.05 | 42.0 | ◎ | ◎ | ◎ |
| 126 | 57.80 | 40.05 | 2.00 | 0.05 | 0 | 0 | 0.05 | 0.05 | 42.0 | X | ◎ | ◎ |
| 127 | 57.90 | 39.93 | 2.00 | 0.07 | 0 | 0 | 0.05 | 0.05 | 42.0 | X | ◎ | ◎ |
| 128 | 58.00 | 39.80 | 2.00 | 0.10 | 0 | 0 | 0.05 | 0.05 | 42.0 | ◎ | ◎ | ◎ |
| 129 | 58.00 | 39.79 | 2.00 | 0.10 | 0.0075 | 0 | 0.05 | 0.05 | 42.0 | ◎ | ◎ | ◎ |
| 130 | 58.00 | 39.79 | 2.00 | 0.10 | 0.0150 | 0 | 0.05 | 0.05 | 42.0 | ◎ | ◎ | ◎ |
| 131 | 58.50 | 39.20 | 2.00 | 0.20 | 0 | 0 | 0.05 | 0.05 | 42.0 | ◎ | ◎ | ◎ |

25

TABLE 8

| No. | Cu | Zn | Bi | Si | B | Al | Sn | Ni | Zinc equivalent | Casting cracking resistance | Machinability | Mechanical properties |
|---|---|---|---|---|---|---|---|---|---|---|---|---|
| 132 | 58.50 | 39.19 | 2.00 | 0.20 | 0.0075 | 0 | 0.05 | 0.05 | 42.0 | ◎ | ◎ | ◎ |
| 133 | 58.50 | 39.19 | 2.00 | 0.20 | 0.0150 | 0 | 0.05 | 0.05 | 42.0 | ◎ | ◎ | ◎ |
| 134 | 55.50 | 42.39 | 2.00 | 0 | 0.0075 | 0 | 0.05 | 0.05 | 44.0 | X | ◎ | ◎ |
| 135 | 55.50 | 42.39 | 2.00 | 0 | 0.0110 | 0 | 0.05 | 0.05 | 44.0 | X | ◎ | ◎ |
| 136 | 55.50 | 42.39 | 2.00 | 0 | 0.0125 | 0 | 0.05 | 0.05 | 44.0 | ◎ | ◎ | ◎ |
| 137 | 55.50 | 42.39 | 2.00 | 0 | 0.0150 | 0 | 0.05 | 0.05 | 44.0 | ◎ | ◎ | ◎ |
| 138 | 55.50 | 42.38 | 2.00 | 0 | 0.0200 | 0 | 0.05 | 0.05 | 44.0 | ◎ | ◎ | ◎ |
| 139 | 55.50 | 42.37 | 2.00 | 0 | 0.0300 | 0 | 0.05 | 0.05 | 44.0 | ◎ | ◎ | ○ |
| 140 | 55.80 | 42.05 | 2.00 | 0.05 | 0 | 0 | 0.05 | 0.05 | 44.0 | X | ◎ | ◎ |
| 141 | 55.90 | 41.93 | 2.00 | 0.07 | 0 | 0 | 0.05 | 0.05 | 44.0 | X | ◎ | ◎ |
| 142 | 56.00 | 41.80 | 2.00 | 0.10 | 0 | 0 | 0.05 | 0.05 | 44.0 | ◎ | ◎ | ◎ |
| 143 | 56.00 | 41.79 | 2.00 | 0.10 | 0.0075 | 0 | 0.05 | 0.05 | 44.0 | ◎ | ◎ | ◎ |
| 144 | 56.00 | 41.79 | 2.00 | 0.10 | 0.0150 | 0 | 0.05 | 0.05 | 44.0 | ◎ | ◎ | ○ |
| 145 | 56.50 | 41.20 | 2.00 | 0.20 | 0 | 0 | 0.05 | 0.05 | 44.0 | ◎ | ◎ | ◎ |
| 146 | 56.50 | 41.19 | 2.00 | 0.20 | 0.0075 | 0 | 0.05 | 0.05 | 44.0 | ◎ | ◎ | ○ |
| 147 | 56.50 | 41.19 | 2.00 | 0.20 | 0.0150 | 0 | 0.05 | 0.05 | 44.0 | ◎ | ◎ | ○ |

TABLE 9

| No. | Cu | Zn | Bi | Si | B | Al | Sn | Ni | Zinc equivalent | Casting cracking resistance | Machinability | Mechanical properties |
|---|---|---|---|---|---|---|---|---|---|---|---|---|
| 148 | 59.80 | 37.99 | 2.00 | 0 | 0.0075 | 0.10 | 0.05 | 0.05 | 40.0 | X | ◎ | ◎ |
| 149 | 59.80 | 37.99 | 2.00 | 0 | 0.0150 | 0.10 | 0.05 | 0.05 | 40.0 | X | ◎ | ◎ |
| 150 | 59.80 | 37.98 | 2.00 | 0 | 0.0200 | 0.10 | 0.05 | 0.05 | 40.0 | ◎ | ◎ | ◎ |
| 151 | 59.80 | 37.97 | 2.00 | 0 | 0.0300 | 0.10 | 0.05 | 0.05 | 40.0 | ◎ | ◎ | ◎ |
| 152 | 60.30 | 37.40 | 2.00 | 0.10 | 0 | 0.10 | 0.05 | 0.05 | 40.0 | X | ◎ | ◎ |
| 153 | 60.30 | 37.39 | 2.00 | 0.10 | 0.0075 | 0.10 | 0.05 | 0.05 | 40.0 | ◎ | ◎ | ◎ |
| 154 | 60.30 | 37.39 | 2.00 | 0.10 | 0.0150 | 0.10 | 0.05 | 0.05 | 40.0 | ◎ | ◎ | ◎ |
| 155 | 60.60 | 37.05 | 2.00 | 0.15 | 0 | 0.10 | 0.05 | 0.05 | 40.0 | ◎ | ◎ | ◎ |
| 156 | 60.90 | 36.70 | 2.00 | 0.20 | 0 | 0.10 | 0.05 | 0.05 | 40.0 | ◎ | ◎ | ◎ |
| 157 | 60.90 | 36.69 | 2.00 | 0.20 | 0.0075 | 0.10 | 0.05 | 0.05 | 40.0 | ◎ | ◎ | ◎ |
| 158 | 60.90 | 36.69 | 2.00 | 0.20 | 0.0150 | 0.10 | 0.05 | 0.05 | 40.0 | ◎ | ◎ | ◎ |
| 159 | 61.40 | 36.10 | 2.00 | 0.30 | 0 | 0.10 | 0.05 | 0.05 | 40.0 | ◎ | ◎ | ◎ |
| 160 | 61.40 | 36.10 | 2.00 | 0.30 | 0.0040 | 0.10 | 0.05 | 0.05 | 40.0 | ◎ | ◎ | ◎ |
| 161 | 61.40 | 36.09 | 2.00 | 0.30 | 0.0075 | 0.10 | 0.05 | 0.05 | 40.0 | ◎ | ◎ | ◎ |
| 162 | 61.40 | 36.09 | 2.00 | 0.30 | 0.0150 | 0.10 | 0.05 | 0.05 | 40.0 | ◎ | ◎ | ◎ |

TABLE 9-continued

| No. | Cu | Zn | Bi | Si | B | Al | Sn | Ni | Zinc equivalent | Casting cracking resistance | Machinability | Mechanical properties |
|---|---|---|---|---|---|---|---|---|---|---|---|---|
| 163 | 62.50 | 34.80 | 2.00 | 0.50 | 0 | 0.10 | 0.05 | 0.05 | 40.0 | ◎ | ◎ | ◎ |
| 164 | 65.20 | 31.60 | 2.00 | 1.00 | 0 | 0.10 | 0.05 | 0.05 | 40.0 | ◎ | ◎ | ◎ |
| 165 | 67.90 | 28.40 | 2.00 | 1.50 | 0 | 0.10 | 0.05 | 0.05 | 40.0 | ◎ | ◎ | ◎ |
| 166 | 70.60 | 25.20 | 2.00 | 2.00 | 0 | 0.10 | 0.05 | 0.05 | 40.0 | ◎ | ◎ | ○ |
| 167 | 60.40 | 37.19 | 2.00 | 0 | 0.0075 | 0.30 | 0.05 | 0.05 | 40.0 | X | ◎ | ◎ |
| 168 | 60.40 | 37.19 | 2.00 | 0 | 0.0150 | 0.30 | 0.05 | 0.05 | 40.0 | X | ◎ | ◎ |
| 169 | 60.40 | 37.18 | 2.00 | 0 | 0.0200 | 0.30 | 0.05 | 0.05 | 40.0 | ◎ | ◎ | ◎ |
| 170 | 60.40 | 37.17 | 2.00 | 0 | 0.0300 | 0.30 | 0.05 | 0.05 | 40.0 | ◎ | ◎ | ◎ |
| 171 | 60.90 | 36.60 | 2.00 | 0.10 | 0 | 0.30 | 0.05 | 0.05 | 40.0 | X | ◎ | ◎ |
| 172 | 60.90 | 36.59 | 2.00 | 0.10 | 0.0075 | 0.30 | 0.05 | 0.05 | 40.0 | ◎ | ◎ | ◎ |
| 173 | 60.90 | 36.59 | 2.00 | 0.10 | 0.0150 | 0.30 | 0.05 | 0.05 | 40.0 | ◎ | ◎ | ◎ |
| 174 | 61.50 | 35.90 | 2.00 | 0.20 | 0 | 0.30 | 0.05 | 0.05 | 40.0 | X | ◎ | ◎ |
| 175 | 61.50 | 35.89 | 2.00 | 0.20 | 0.0075 | 0.30 | 0.05 | 0.05 | 40.0 | ◎ | ◎ | ◎ |
| 176 | 61.50 | 35.89 | 2.00 | 0.20 | 0.0150 | 0.30 | 0.05 | 0.05 | 40.0 | ◎ | ◎ | ◎ |
| 177 | 62.00 | 35.30 | 2.00 | 0.30 | 0 | 0.30 | 0.05 | 0.05 | 40.0 | X | ◎ | ◎ |
| 178 | 62.00 | 35.30 | 2.00 | 0.30 | 0.0020 | 0.30 | 0.05 | 0.05 | 40.0 | ◎ | ◎ | ◎ |
| 179 | 62.00 | 35.30 | 2.00 | 0.30 | 0.0040 | 0.30 | 0.05 | 0.05 | 40.0 | ◎ | ◎ | ◎ |

TABLE 10

| No. | Cu | Zn | Bi | Si | B | Al | Sn | Ni | Zinc equivalent | Casting cracking resistance | Machinability | Mechanical properties |
|---|---|---|---|---|---|---|---|---|---|---|---|---|
| 180 | 62.00 | 35.29 | 2.00 | 0.30 | 0.0075 | 0.30 | 0.05 | 0.05 | 40.0 | ◎ | ◎ | ◎ |
| 181 | 62.00 | 35.29 | 2.00 | 0.30 | 0.0150 | 0.30 | 0.05 | 0.05 | 40.0 | ◎ | ◎ | ◎ |
| 182 | 62.00 | 35.27 | 2.00 | 0.30 | 0.0300 | 0.30 | 0.05 | 0.05 | 40.0 | ◎ | ◎ | ◎ |
| 183 | 63.10 | 34.00 | 2.00 | 0.50 | 0 | 0.30 | 0.05 | 0.05 | 40.0 | X | ◎ | ◎ |
| 184 | 63.10 | 34.00 | 2.00 | 0.50 | 0.0005 | 0.30 | 0.05 | 0.05 | 40.0 | ◎ | ◎ | ◎ |
| 185 | 63.10 | 34.00 | 2.00 | 0.50 | 0.0010 | 0.30 | 0.05 | 0.05 | 40.0 | ◎ | ◎ | ◎ |
| 186 | 63.10 | 34.00 | 2.00 | 0.50 | 0.0020 | 0.30 | 0.05 | 0.05 | 40.0 | ◎ | ◎ | ◎ |
| 187 | 63.10 | 34.00 | 2.00 | 0.50 | 0.0040 | 0.30 | 0.05 | 0.05 | 40.0 | ◎ | ◎ | ◎ |
| 188 | 65.80 | 30.80 | 2.00 | 1.00 | 0 | 0.30 | 0.05 | 0.05 | 40.0 | X | ◎ | ◎ |
| 189 | 65.80 | 30.80 | 2.00 | 1.00 | 0.0005 | 0.30 | 0.05 | 0.05 | 40.0 | ◎ | ◎ | ◎ |
| 190 | 65.80 | 30.80 | 2.00 | 1.00 | 0.0010 | 0.30 | 0.05 | 0.05 | 40.0 | ◎ | ◎ | ◎ |
| 191 | 65.80 | 30.80 | 2.00 | 1.00 | 0.0020 | 0.30 | 0.05 | 0.05 | 40.0 | ◎ | ◎ | ◎ |
| 192 | 68.50 | 27.60 | 2.00 | 1.50 | 0 | 0.30 | 0.05 | 0.05 | 40.0 | X | ◎ | ◎ |
| 193 | 68.50 | 27.60 | 2.00 | 1.50 | 0.0005 | 0.30 | 0.05 | 0.05 | 40.0 | ◎ | ◎ | ◎ |
| 194 | 68.50 | 27.60 | 2.00 | 1.50 | 0.0010 | 0.30 | 0.05 | 0.05 | 40.0 | ◎ | ◎ | ◎ |
| 195 | 71.20 | 24.40 | 2.00 | 2.00 | 0 | 0.30 | 0.05 | 0.05 | 40.0 | X | ◎ | ○ |
| 196 | 71.20 | 24.40 | 2.00 | 2.00 | 0.0005 | 0.30 | 0.05 | 0.05 | 40.0 | X | ◎ | ○ |
| 197 | 71.20 | 24.40 | 2.00 | 2.00 | 0.0010 | 0.30 | 0.05 | 0.05 | 40.0 | X | ◎ | ○ |
| 198 | 71.20 | 24.40 | 2.00 | 2.00 | 0.0020 | 0.30 | 0.05 | 0.05 | 40.0 | ◎ | ◎ | ○ |
| 199 | 62.50 | 34.39 | 2.00 | 0 | 0.0075 | 1.00 | 0.05 | 0.05 | 40.0 | X | ◎ | ◎ |
| 200 | 62.50 | 34.39 | 2.00 | 0 | 0.0150 | 1.00 | 0.05 | 0.05 | 40.0 | X | ◎ | ◎ |
| 201 | 62.50 | 34.38 | 2.00 | 0 | 0.0200 | 1.00 | 0.05 | 0.05 | 40.0 | X | ◎ | ◎ |
| 202 | 62.50 | 34.37 | 2.00 | 0 | 0.0300 | 1.00 | 0.05 | 0.05 | 40.0 | X | ◎ | ◎ |
| 203 | 63.00 | 33.80 | 2.00 | 0.10 | 0 | 1.00 | 0.05 | 0.05 | 40.0 | X | ◎ | ◎ |
| 204 | 63.00 | 33.79 | 2.00 | 0.10 | 0.0075 | 1.00 | 0.05 | 0.05 | 40.0 | ◎ | ◎ | ◎ |
| 205 | 63.00 | 33.79 | 2.00 | 0.10 | 0.0150 | 1.00 | 0.05 | 0.05 | 40.0 | ◎ | ◎ | ◎ |
| 206 | 63.60 | 33.10 | 2.00 | 0.20 | 0 | 1.00 | 0.05 | 0.05 | 40.0 | X | ◎ | ◎ |
| 207 | 63.60 | 33.09 | 2.00 | 0.20 | 0.0075 | 1.00 | 0.05 | 0.05 | 40.0 | ◎ | ◎ | ◎ |
| 208 | 63.60 | 33.09 | 2.00 | 0.20 | 0.0150 | 1.00 | 0.05 | 0.05 | 40.0 | ◎ | ◎ | ◎ |
| 209 | 64.10 | 32.50 | 2.00 | 0.30 | 0 | 1.00 | 0.05 | 0.05 | 40.0 | X | ◎ | ◎ |
| 210 | 64.10 | 32.50 | 2.00 | 0.30 | 0.0040 | 1.00 | 0.05 | 0.05 | 40.0 | X | ◎ | ◎ |
| 211 | 64.10 | 32.49 | 2.00 | 0.30 | 0.0075 | 1.00 | 0.05 | 0.05 | 40.0 | ◎ | ◎ | ◎ |
| 212 | 64.10 | 32.49 | 2.00 | 0.30 | 0.0150 | 1.00 | 0.05 | 0.05 | 40.0 | ◎ | ◎ | ◎ |
| 213 | 65.20 | 31.20 | 2.00 | 0.50 | 0.0010 | 1.00 | 0.05 | 0.05 | 40.0 | X | ◎ | ◎ |

TABLE 11

| No. | Cu | Zn | Bi | Si | B | Al | Sn | Ni | Zinc equivalent | Casting cracking resistance | Machinability | Mechanical properties |
|---|---|---|---|---|---|---|---|---|---|---|---|---|
| 214 | 65.20 | 31.20 | 2.00 | 0.50 | 0.0020 | 1.00 | 0.05 | 0.05 | 40.0 | X | ◎ | ◎ |
| 215 | 65.20 | 31.20 | 2.00 | 0.50 | 0.0040 | 1.00 | 0.05 | 0.05 | 40.0 | ◎ | ◎ | ◎ |

TABLE 11-continued

| No. | Cu | Zn | Bi | Si | B | Al | Sn | Ni | Zinc equivalent | Casting cracking resistance | Machinability | Mechanical properties |
|---|---|---|---|---|---|---|---|---|---|---|---|---|
| 216 | 67.90 | 28.00 | 2.00 | 1.00 | 0 | 1.00 | 0.05 | 0.05 | 40.0 | X | ◎ | ◎ |
| 217 | 67.90 | 28.00 | 2.00 | 1.00 | 0.0005 | 1.00 | 0.05 | 0.05 | 40.0 | ◎ | ◎ | ◎ |
| 218 | 67.90 | 28.00 | 2.00 | 1.00 | 0.0010 | 1.00 | 0.05 | 0.05 | 40.0 | ◎ | ◎ | ◎ |
| 219 | 67.90 | 28.00 | 2.00 | 1.00 | 0.0020 | 1.00 | 0.05 | 0.05 | 40.0 | ◎ | ◎ | ◎ |
| 220 | 67.90 | 28.00 | 2.00 | 1.00 | 0.0040 | 1.00 | 0.05 | 0.05 | 40.0 | ◎ | ◎ | ◎ |
| 221 | 70.60 | 24.80 | 2.00 | 1.50 | 0.0005 | 1.00 | 0.05 | 0.05 | 40.0 | X | ◎ | ◎ |
| 222 | 70.60 | 24.80 | 2.00 | 1.50 | 0.0010 | 1.00 | 0.05 | 0.05 | 40.0 | ◎ | ◎ | ◎ |
| 223 | 70.60 | 24.80 | 2.00 | 1.50 | 0.0020 | 1.00 | 0.05 | 0.05 | 40.0 | ◎ | ◎ | ◎ |
| 224 | 73.30 | 21.60 | 2.00 | 2.00 | 0.0005 | 1.00 | 0.05 | 0.05 | 40.0 | X | ◎ | ○ |
| 225 | 73.30 | 21.60 | 2.00 | 2.00 | 0.0010 | 1.00 | 0.05 | 0.05 | 40.0 | ◎ | ◎ | ○ |
| 226 | 73.30 | 21.60 | 2.00 | 2.00 | 0.0020 | 1.00 | 0.05 | 0.05 | 40.0 | ◎ | ◎ | ○ |
| 227 | 63.50 | 32.57 | 2.00 | 0.30 | 0.0300 | 1.50 | 0.05 | 0.05 | 41.9 | ◎ | ◎ | ◎ |
| 228 | 65.00 | 30.57 | 2.00 | 0.30 | 0.0300 | 2.00 | 0.05 | 0.05 | 41.9 | ◎ | ◎ | ○ |

TABLE 12

| No. | Cu | Zn | Bi | Si | B | Al | Sn | Ni | Zinc equivalent | Casting cracking resistance | Machinability | Mechanical properties |
|---|---|---|---|---|---|---|---|---|---|---|---|---|
| 229 | 59.50 | 38.34 | 2.00 | 0 | 0.0075 | 0 | 0.10 | 0.05 | 40.0 | X | ◎ | ◎ |
| 230 | 59.50 | 38.34 | 2.00 | 0 | 0.0150 | 0 | 0.10 | 0.05 | 40.0 | X | ◎ | ◎ |
| 231 | 59.50 | 38.33 | 2.00 | 0 | 0.0200 | 0 | 0.10 | 0.05 | 40.0 | X | ◎ | ◎ |
| 232 | 59.50 | 38.32 | 2.00 | 0 | 0.0300 | 0 | 0.10 | 0.05 | 40.0 | ◎ | ◎ | ◎ |
| 233 | 60.10 | 37.65 | 2.00 | 0.10 | 0 | 0 | 0.10 | 0.05 | 40.0 | X | ◎ | ◎ |
| 234 | 60.10 | 37.65 | 2.00 | 0.10 | 0.0040 | 0 | 0.10 | 0.05 | 40.0 | X | ◎ | ◎ |
| 235 | 60.10 | 37.64 | 2.00 | 0.10 | 0.0075 | 0 | 0.10 | 0.05 | 40.0 | ◎ | ◎ | ◎ |
| 236 | 60.10 | 37.64 | 2.00 | 0.10 | 0.0150 | 0 | 0.10 | 0.05 | 40.0 | ◎ | ◎ | ◎ |
| 237 | 60.60 | 37.05 | 2.00 | 0.20 | 0 | 0 | 0.10 | 0.05 | 40.0 | X | ◎ | ◎ |
| 238 | 60.60 | 37.05 | 2.00 | 0.20 | 0.0020 | 0 | 0.10 | 0.05 | 40.0 | ◎ | ◎ | ◎ |
| 239 | 60.60 | 37.05 | 2.00 | 0.20 | 0.0040 | 0 | 0.10 | 0.05 | 40.0 | ◎ | ◎ | ◎ |
| 240 | 60.60 | 37.04 | 2.00 | 0.20 | 0.0075 | 0 | 0.10 | 0.05 | 40.0 | ◎ | ◎ | ◎ |
| 241 | 61.10 | 36.45 | 2.00 | 0.30 | 0 | 0 | 0.10 | 0.05 | 40.0 | X | ◎ | ◎ |
| 242 | 61.10 | 36.45 | 2.00 | 0.30 | 0.0020 | 0 | 0.10 | 0.05 | 40.0 | ◎ | ◎ | ◎ |
| 243 | 61.10 | 36.45 | 2.00 | 0.30 | 0.0040 | 0 | 0.10 | 0.05 | 40.0 | ◎ | ◎ | ◎ |
| 244 | 61.10 | 36.44 | 2.00 | 0.30 | 0.0075 | 0 | 0.10 | 0.05 | 40.0 | ◎ | ◎ | ◎ |
| 245 | 62.20 | 35.15 | 2.00 | 0.50 | 0 | 0 | 0.10 | 0.05 | 40.0 | ◎ | ◎ | ◎ |
| 246 | 62.20 | 35.15 | 2.00 | 0.50 | 0.0005 | 0 | 0.10 | 0.05 | 40.0 | ◎ | ◎ | ◎ |
| 247 | 62.20 | 35.15 | 2.00 | 0.50 | 0.0010 | 0 | 0.10 | 0.05 | 40.0 | ◎ | ◎ | ◎ |
| 248 | 62.20 | 35.15 | 2.00 | 0.50 | 0.0020 | 0 | 0.10 | 0.05 | 40.0 | ◎ | ◎ | ◎ |
| 249 | 64.90 | 31.95 | 2.00 | 1.00 | 0 | 0 | 0.10 | 0.05 | 40.0 | ◎ | ◎ | ◎ |
| 250 | 64.90 | 31.95 | 2.00 | 1.00 | 0.0005 | 0 | 0.10 | 0.05 | 40.0 | ◎ | ◎ | ◎ |
| 251 | 64.90 | 31.95 | 2.00 | 1.00 | 0.0010 | 0 | 0.10 | 0.05 | 40.0 | ◎ | ◎ | ◎ |
| 252 | 67.60 | 28.75 | 2.00 | 1.50 | 0 | 0 | 0.10 | 0.05 | 40.0 | ◎ | ◎ | ◎ |
| 253 | 67.60 | 28.75 | 2.00 | 1.50 | 0.0005 | 0 | 0.10 | 0.05 | 40.0 | ◎ | ◎ | ◎ |
| 254 | 67.60 | 28.75 | 2.00 | 1.50 | 0.0010 | 0 | 0.10 | 0.05 | 40.0 | ◎ | ◎ | ◎ |
| 255 | 70.30 | 25.55 | 2.00 | 2.00 | 0 | 0 | 0.10 | 0.05 | 40.0 | ◎ | ◎ | ○ |
| 256 | 59.60 | 38.04 | 2.00 | 0 | 0.0075 | 0 | 0.30 | 0.05 | 40.0 | X | ◎ | ◎ |
| 257 | 59.60 | 38.04 | 2.00 | 0 | 0.0150 | 0 | 0.30 | 0.05 | 40.0 | X | ◎ | ◎ |
| 258 | 59.60 | 38.03 | 2.00 | 0 | 0.0200 | 0 | 0.30 | 0.05 | 40.0 | X | ◎ | ◎ |
| 259 | 59.60 | 38.02 | 2.00 | 0 | 0.0300 | 0 | 0.30 | 0.05 | 40.0 | ◎ | ◎ | ◎ |
| 260 | 60.20 | 37.35 | 2.00 | 0.10 | 0 | 0 | 0.30 | 0.05 | 40.0 | X | ◎ | ◎ |

TABLE 13

| No. | Cu | Zn | Bi | Si | B | Al | Sn | Ni | Zinc equivalent | Casting cracking resistance | Machinability | Mechanical properties |
|---|---|---|---|---|---|---|---|---|---|---|---|---|
| 261 | 60.20 | 37.34 | 2.00 | 0.10 | 0.0075 | 0 | 0.30 | 0.05 | 40.0 | X | ◎ | ◎ |
| 262 | 60.20 | 37.34 | 2.00 | 0.10 | 0.0150 | 0 | 0.30 | 0.05 | 40.0 | ◎ | ◎ | ◎ |
| 263 | 60.70 | 36.75 | 2.00 | 0.20 | 0 | 0 | 0.30 | 0.05 | 40.0 | X | ◎ | ◎ |
| 264 | 60.70 | 36.75 | 2.00 | 0.20 | 0.0040 | 0 | 0.30 | 0.05 | 40.0 | X | ◎ | ◎ |
| 265 | 60.70 | 36.74 | 2.00 | 0.20 | 0.0075 | 0 | 0.30 | 0.05 | 40.0 | ◎ | ◎ | ◎ |
| 266 | 61.20 | 36.15 | 2.00 | 0.30 | 0 | 0 | 0.30 | 0.05 | 40.0 | X | ◎ | ◎ |
| 267 | 61.30 | 36.05 | 2.00 | 0.30 | 0.0020 | 0 | 0.30 | 0.05 | 40.0 | ◎ | ◎ | ◎ |
| 268 | 61.30 | 36.05 | 2.00 | 0.30 | 0.0040 | 0 | 0.30 | 0.05 | 40.0 | ◎ | ◎ | ◎ |
| 269 | 61.30 | 36.04 | 2.00 | 0.30 | 0.0075 | 0 | 0.30 | 0.05 | 40.0 | ◎ | ◎ | ◎ |
| 270 | 62.30 | 34.85 | 2.00 | 0.50 | 0 | 0 | 0.30 | 0.05 | 40.0 | X | ◎ | ◎ |
| 271 | 62.30 | 34.85 | 2.00 | 0.50 | 0.0005 | 0 | 0.30 | 0.05 | 40.0 | ◎ | ◎ | ◎ |
| 272 | 62.30 | 34.85 | 2.00 | 0.50 | 0.0010 | 0 | 0.30 | 0.05 | 40.0 | ◎ | ◎ | ◎ |

TABLE 13-continued

| No. | Cu | Zn | Bi | Si | B | Al | Sn | Ni | Zinc equivalent | Casting cracking resistance | Machinability | Mechanical properties |
|---|---|---|---|---|---|---|---|---|---|---|---|---|
| 273 | 62.30 | 34.85 | 2.00 | 0.50 | 0.0020 | 0 | 0.30 | 0.05 | 40.0 | ◎ | ◎ | ◎ |
| 274 | 65.00 | 31.65 | 2.00 | 1.00 | 0 | 0 | 0.30 | 0.05 | 40.0 | X | ◎ | ◎ |
| 275 | 65.00 | 31.65 | 2.00 | 1.00 | 0.0005 | 0 | 0.30 | 0.05 | 40.0 | ◎ | ◎ | ◎ |
| 276 | 65.00 | 31.65 | 2.00 | 1.00 | 0.0010 | 0 | 0.30 | 0.05 | 40.0 | ◎ | ◎ | ◎ |
| 277 | 67.70 | 28.45 | 2.00 | 1.50 | 0 | 0 | 0.30 | 0.05 | 40.0 | ◎ | ◎ | ◎ |
| 278 | 67.70 | 28.45 | 2.00 | 1.50 | 0.0005 | 0 | 0.30 | 0.05 | 40.0 | ◎ | ◎ | ◎ |
| 279 | 67.70 | 28.45 | 2.00 | 1.50 | 0.0010 | 0 | 0.30 | 0.05 | 40.0 | ◎ | ◎ | ◎ |
| 280 | 70.40 | 25.25 | 2.00 | 2.00 | 0 | 0 | 0.30 | 0.05 | 40.0 | X | ◎ | ○ |
| 281 | 70.40 | 25.25 | 2.00 | 2.00 | 0.0005 | 0 | 0.30 | 0.05 | 40.0 | X | ◎ | ○ |
| 282 | 70.40 | 25.25 | 2.00 | 2.00 | 0.0010 | 0 | 0.30 | 0.05 | 40.0 | ◎ | ◎ | ○ |
| 283 | 60.40 | 36.04 | 2.00 | 0 | 0.0075 | 0 | 1.50 | 0.05 | 40.0 | X | ◎ | ◎ |
| 284 | 60.40 | 36.04 | 2.00 | 0 | 0.0150 | 0 | 1.50 | 0.05 | 40.0 | X | ◎ | ◎ |
| 285 | 60.40 | 36.03 | 2.00 | 0 | 0.0200 | 0 | 1.50 | 0.05 | 40.0 | X | ◎ | ◎ |
| 286 | 60.40 | 36.02 | 2.00 | 0 | 0.0300 | 0 | 1.50 | 0.05 | 40.0 | ◎ | ◎ | ◎ |
| 287 | 60.90 | 35.45 | 2.00 | 0.10 | 0 | 0 | 1.50 | 0.05 | 40.0 | X | ◎ | ◎ |
| 288 | 60.90 | 35.44 | 2.00 | 0.10 | 0.0075 | 0 | 1.50 | 0.05 | 40.0 | X | ◎ | ◎ |
| 289 | 60.90 | 35.44 | 2.00 | 0.10 | 0.0150 | 0 | 1.50 | 0.05 | 40.0 | X | ◎ | ◎ |
| 290 | 60.90 | 35.43 | 2.00 | 0.10 | 0.0250 | 0 | 1.50 | 0.05 | 40.0 | X | ◎ | ◎ |
| 291 | 60.90 | 35.42 | 2.00 | 0.10 | 0.0300 | 0 | 1.50 | 0.05 | 40.0 | ◎ | ◎ | ◎ |
| 292 | 61.40 | 34.85 | 2.00 | 0.20 | 0 | 0 | 1.50 | 0.05 | 40.0 | X | ◎ | ◎ |
| 293 | 61.40 | 34.84 | 2.00 | 0.20 | 0.0075 | 0 | 1.50 | 0.05 | 40.0 | X | ◎ | ◎ |
| 294 | 61.40 | 34.84 | 2.00 | 0.20 | 0.0150 | 0 | 1.50 | 0.05 | 40.0 | X | ◎ | ◎ |

TABLE 14

| No. | Cu | Zn | Bi | Si | B | Al | Sn | Ni | Zinc equivalent | Casting cracking resistance | Machinability | Mechanical properties |
|---|---|---|---|---|---|---|---|---|---|---|---|---|
| 295 | 61.40 | 34.83 | 2.00 | 0.20 | 0.0250 | 0 | 1.50 | 0.05 | 40.0 | ◎ | ◎ | ◎ |
| 296 | 62.00 | 34.15 | 2.00 | 0.30 | 0 | 0 | 1.50 | 0.05 | 40.0 | X | ◎ | ◎ |
| 297 | 62.00 | 34.15 | 2.00 | 0.30 | 0.0040 | 0 | 1.50 | 0.05 | 40.0 | X | ◎ | ◎ |
| 298 | 62.00 | 34.14 | 2.00 | 0.30 | 0.0075 | 0 | 1.50 | 0.05 | 40.0 | ◎ | ◎ | ◎ |
| 299 | 62.00 | 34.12 | 2.00 | 0.30 | 0.0300 | 0 | 1.50 | 0.05 | 40.0 | ◎ | ◎ | ○ |
| 300 | 63.00 | 32.95 | 2.00 | 0.50 | 0.0010 | 0 | 1.50 | 0.05 | 40.0 | X | ◎ | ◎ |
| 301 | 63.00 | 32.95 | 2.00 | 0.50 | 0.0020 | 0 | 1.50 | 0.05 | 40.0 | X | ◎ | ◎ |
| 302 | 63.00 | 32.95 | 2.00 | 0.50 | 0.0040 | 0 | 1.50 | 0.05 | 40.0 | X | ◎ | ◎ |
| 303 | 63.00 | 32.94 | 2.00 | 0.50 | 0.0075 | 0 | 1.50 | 0.05 | 40.0 | ◎ | ◎ | ◎ |
| 304 | 65.70 | 29.75 | 2.00 | 1.00 | 0.0005 | 0 | 1.50 | 0.05 | 40.0 | X | ○ | ○ |
| 305 | 65.70 | 29.75 | 2.00 | 1.00 | 0.0010 | 0 | 1.50 | 0.05 | 40.0 | X | ○ | ○ |
| 306 | 65.70 | 29.75 | 2.00 | 1.00 | 0.0020 | 0 | 1.50 | 0.05 | 40.0 | X | ○ | ○ |
| 307 | 65.70 | 29.75 | 2.00 | 1.00 | 0.0040 | 0 | 1.50 | 0.05 | 40.0 | X | ○ | ○ |
| 308 | 65.70 | 29.74 | 2.00 | 1.00 | 0.0075 | 0 | 1.50 | 0.05 | 40.0 | X | ○ | ○ |
| 309 | 65.70 | 29.74 | 2.00 | 1.00 | 0.0150 | 0 | 1.50 | 0.05 | 40.0 | ◎ | ○ | ○ |
| 310 | 68.40 | 26.55 | 2.00 | 1.50 | 0 | 0 | 1.50 | 0.05 | 40.0 | X | ○ | ○ |
| 311 | 68.40 | 26.55 | 2.00 | 1.50 | 0.0005 | 0 | 1.50 | 0.05 | 40.0 | X | ○ | ○ |
| 312 | 68.40 | 26.55 | 2.00 | 1.50 | 0.0010 | 0 | 1.50 | 0.05 | 40.0 | X | ○ | ○ |
| 313 | 68.40 | 26.55 | 2.00 | 1.50 | 0.0040 | 0 | 1.50 | 0.05 | 40.0 | X | ○ | ○ |
| 314 | 68.40 | 26.54 | 2.00 | 1.50 | 0.0075 | 0 | 1.50 | 0.05 | 40.0 | X | ○ | ○ |
| 315 | 68.40 | 26.54 | 2.00 | 1.50 | 0.0150 | 0 | 1.50 | 0.05 | 40.0 | X | ○ | ○ |
| 316 | 68.40 | 26.52 | 2.00 | 1.50 | 0.0300 | 0 | 1.50 | 0.05 | 40.0 | X | ○ | ○ |
| 317 | 71.10 | 23.35 | 2.00 | 2.00 | 0 | 0 | 1.50 | 0.05 | 40.0 | X | ○ | ○ |
| 318 | 71.10 | 23.35 | 2.00 | 2.00 | 0.0005 | 0 | 1.50 | 0.05 | 40.0 | X | ○ | ○ |
| 319 | 71.10 | 23.35 | 2.00 | 2.00 | 0.0010 | 0 | 1.50 | 0.05 | 40.0 | X | ○ | ○ |
| 320 | 71.10 | 23.35 | 2.00 | 2.00 | 0.0040 | 0 | 1.50 | 0.05 | 40.0 | X | ○ | ○ |
| 321 | 71.10 | 23.34 | 2.00 | 2.00 | 0.0075 | 0 | 1.50 | 0.05 | 40.0 | X | ○ | ○ |
| 322 | 71.10 | 23.34 | 2.00 | 2.00 | 0.0150 | 0 | 1.50 | 0.05 | 40.0 | X | ○ | ○ |
| 323 | 71.10 | 23.32 | 2.00 | 2.00 | 0.0300 | 0 | 1.50 | 0.05 | 40.0 | X | ○ | ○ |
| 324 | 62.00 | 33.37 | 2.00 | 0.30 | 0.0300 | 0.30 | 2.00 | 0 | 41.2 | ◎ | ◎ | ○ |
| 325 | 62.00 | 32.37 | 2.00 | 0.30 | 0.0300 | 0.30 | 3.00 | 0 | 41.7 | ◎ | ○ | ○ |

TABLE 15

| No. | Cu | Zn | Bi | Si | B | Al | Sn | Ni | Zinc equivalent | Casting cracking resistance | Machinability | Mechanical properties |
|---|---|---|---|---|---|---|---|---|---|---|---|---|
| 326 | 59.40 | 38.44 | 2.00 | 0 | 0.0075 | 0 | 0.05 | 0.10 | 40.0 | X | ◎ | ◎ |
| 327 | 59.40 | 38.44 | 2.00 | 0 | 0.0150 | 0 | 0.05 | 0.10 | 40.0 | X | ◎ | ◎ |
| 328 | 59.40 | 38.42 | 2.00 | 0 | 0.0300 | 0 | 0.05 | 0.10 | 40.0 | X | ◎ | ◎ |
| 329 | 60.00 | 37.75 | 2.00 | 0.10 | 0 | 0 | 0.05 | 0.10 | 40.0 | X | ◎ | ◎ |

TABLE 15-continued

| No. | Cu | Zn | Bi | Si | B | Al | Sn | Ni | Zinc equivalent | Casting cracking resistance | Machinability | Mechanical properties |
|---|---|---|---|---|---|---|---|---|---|---|---|---|
| 330 | 60.00 | 37.75 | 2.00 | 0.10 | 0.0040 | 0 | 0.05 | 0.10 | 40.0 | ◎ | ◎ | ◎ |
| 331 | 60.00 | 37.74 | 2.00 | 0.10 | 0.0075 | 0 | 0.05 | 0.10 | 40.0 | ◎ | ◎ | ◎ |
| 332 | 60.00 | 37.74 | 2.00 | 0.10 | 0.0150 | 0 | 0.05 | 0.10 | 40.0 | ◎ | ◎ | ◎ |
| 333 | 60.50 | 37.15 | 2.00 | 0.20 | 0 | 0 | 0.05 | 0.10 | 40.0 | X | ◎ | ◎ |
| 334 | 60.50 | 37.14 | 2.00 | 0.20 | 0.0075 | 0 | 0.05 | 0.10 | 40.0 | ◎ | ◎ | ◎ |
| 335 | 60.50 | 37.14 | 2.00 | 0.20 | 0.0150 | 0 | 0.05 | 0.10 | 40.0 | ◎ | ◎ | ◎ |
| 336 | 61.00 | 36.55 | 2.00 | 0.30 | 0 | 0 | 0.05 | 0.10 | 40.0 | X | ◎ | ◎ |
| 337 | 61.00 | 36.55 | 2.00 | 0.30 | 0.0020 | 0 | 0.05 | 0.10 | 40.0 | ◎ | ◎ | ◎ |
| 338 | 61.00 | 36.55 | 2.00 | 0.30 | 0.0040 | 0 | 0.05 | 0.10 | 40.0 | ◎ | ◎ | ◎ |
| 339 | 61.00 | 36.54 | 2.00 | 0.30 | 0.0075 | 0 | 0.05 | 0.10 | 40.0 | ◎ | ◎ | ◎ |
| 340 | 61.00 | 36.54 | 2.00 | 0.30 | 0.0150 | 0 | 0.05 | 0.10 | 40.0 | ◎ | ◎ | ◎ |
| 341 | 62.10 | 35.25 | 2.00 | 0.50 | 0 | 0 | 0.05 | 0.10 | 40.0 | X | ◎ | ◎ |
| 342 | 62.10 | 35.25 | 2.00 | 0.50 | 0.0005 | 0 | 0.05 | 0.10 | 40.0 | ◎ | ◎ | ◎ |
| 343 | 62.10 | 35.25 | 2.00 | 0.50 | 0.0010 | 0 | 0.05 | 0.10 | 40.0 | ◎ | ◎ | ◎ |
| 344 | 62.10 | 35.25 | 2.00 | 0.50 | 0.0020 | 0 | 0.05 | 0.10 | 40.0 | ◎ | ◎ | ◎ |
| 345 | 64.80 | 32.05 | 2.00 | 1.00 | 0 | 0 | 0.05 | 0.10 | 40.0 | ◎ | ◎ | ◎ |
| 346 | 64.80 | 32.05 | 2.00 | 1.00 | 0.0005 | 0 | 0.05 | 0.10 | 40.0 | ◎ | ◎ | ◎ |
| 347 | 67.50 | 28.85 | 2.00 | 1.50 | 0 | 0 | 0.05 | 0.10 | 40.0 | ◎ | ◎ | ◎ |
| 348 | 67.50 | 28.85 | 2.00 | 1.50 | 0.0005 | 0 | 0.05 | 0.10 | 40.0 | ◎ | ◎ | ◎ |
| 349 | 70.20 | 25.65 | 2.00 | 2.00 | 0 | 0 | 0.05 | 0.10 | 40.0 | ◎ | ○ | ◎ |
| 350 | 59.10 | 38.54 | 2.00 | 0 | 0.0075 | 0 | 0.05 | 0.30 | 40.0 | X | ◎ | ◎ |
| 351 | 59.10 | 38.54 | 2.00 | 0 | 0.0150 | 0 | 0.05 | 0.30 | 40.0 | X | ◎ | ◎ |
| 352 | 59.10 | 38.53 | 2.00 | 0 | 0.0200 | 0 | 0.05 | 0.30 | 40.0 | X | ◎ | ◎ |
| 353 | 59.10 | 38.52 | 2.00 | 0 | 0.0300 | 0 | 0.05 | 0.30 | 40.0 | X | ◎ | ◎ |
| 354 | 59.70 | 37.85 | 2.00 | 0.10 | 0 | 0 | 0.05 | 0.30 | 40.0 | X | ◎ | ◎ |
| 355 | 59.70 | 37.84 | 2.00 | 0.10 | 0.0075 | 0 | 0.05 | 0.30 | 40.0 | X | ◎ | ◎ |
| 356 | 59.70 | 37.84 | 2.00 | 0.10 | 0.0150 | 0 | 0.05 | 0.30 | 40.0 | X | ◎ | ◎ |
| 357 | 59.70 | 37.83 | 2.00 | 0.10 | 0.0200 | 0 | 0.05 | 0.30 | 40.0 | ◎ | ◎ | ◎ |
| 358 | 59.70 | 37.82 | 2.00 | 0.10 | 0.0300 | 0 | 0.05 | 0.30 | 40.0 | ◎ | ◎ | ◎ |

TABLE 16

| No. | Cu | Zn | Bi | Si | B | Al | Sn | Ni | Zinc equivalent | Casting cracking resistance | Machinability | Mechanical properties |
|---|---|---|---|---|---|---|---|---|---|---|---|---|
| 359 | 60.20 | 37.25 | 2.00 | 0.20 | 0 | 0 | 0.05 | 0.30 | 40.0 | X | ◎ | ◎ |
| 360 | 60.20 | 37.24 | 2.00 | 0.20 | 0.0075 | 0 | 0.05 | 0.30 | 40.0 | ◎ | ◎ | ◎ |
| 361 | 60.20 | 37.24 | 2.00 | 0.20 | 0.0150 | 0 | 0.05 | 0.30 | 40.0 | ◎ | ◎ | ◎ |
| 362 | 60.20 | 37.23 | 2.00 | 0.20 | 0.0200 | 0 | 0.05 | 0.30 | 40.0 | ◎ | ◎ | ◎ |
| 363 | 60.20 | 37.23 | 2.00 | 0.20 | 0.0250 | 0 | 0.05 | 0.30 | 40.0 | ◎ | ◎ | ◎ |
| 364 | 60.20 | 37.22 | 2.00 | 0.20 | 0.0300 | 0 | 0.05 | 0.30 | 40.0 | ◎ | ◎ | ◎ |
| 365 | 60.80 | 36.55 | 2.00 | 0.30 | 0 | 0 | 0.05 | 0.30 | 40.0 | X | ◎ | ◎ |
| 366 | 60.80 | 36.55 | 2.00 | 0.30 | 0.0020 | 0 | 0.05 | 0.30 | 40.0 | ◎ | ◎ | ◎ |
| 367 | 60.80 | 36.55 | 2.00 | 0.30 | 0.0040 | 0 | 0.05 | 0.30 | 40.0 | ◎ | ◎ | ◎ |
| 368 | 60.80 | 36.54 | 2.00 | 0.30 | 0.0075 | 0 | 0.05 | 0.30 | 40.0 | ◎ | ◎ | ◎ |
| 369 | 60.80 | 36.54 | 2.00 | 0.30 | 0.0150 | 0 | 0.05 | 0.30 | 40.0 | ◎ | ◎ | ◎ |
| 370 | 60.80 | 36.52 | 2.00 | 0.30 | 0.0300 | 0 | 0.05 | 0.30 | 40.0 | ◎ | ◎ | ◎ |
| 371 | 61.80 | 35.35 | 2.00 | 0.50 | 0 | 0 | 0.05 | 0.30 | 40.0 | X | ◎ | ◎ |
| 372 | 61.80 | 35.35 | 2.00 | 0.50 | 0.0005 | 0 | 0.05 | 0.30 | 40.0 | ◎ | ◎ | ◎ |
| 373 | 61.80 | 35.35 | 2.00 | 0.50 | 0.0010 | 0 | 0.05 | 0.30 | 40.0 | ◎ | ◎ | ◎ |
| 374 | 61.80 | 35.35 | 2.00 | 0.50 | 0.0020 | 0 | 0.05 | 0.30 | 40.0 | ◎ | ◎ | ◎ |
| 375 | 64.50 | 32.15 | 2.00 | 1.00 | 0 | 0 | 0.05 | 0.30 | 40.0 | ◎ | ◎ | ◎ |
| 376 | 64.50 | 32.15 | 2.00 | 1.00 | 0.0005 | 0 | 0.05 | 0.30 | 40.0 | ◎ | ◎ | ◎ |
| 377 | 64.50 | 32.15 | 2.00 | 1.00 | 0.0010 | 0 | 0.05 | 0.30 | 40.0 | ◎ | ◎ | ◎ |
| 378 | 67.20 | 28.95 | 2.00 | 1.50 | 0 | 0 | 0.05 | 0.30 | 40.0 | ◎ | ◎ | ◎ |
| 379 | 67.20 | 28.95 | 2.00 | 1.50 | 0.0005 | 0 | 0.05 | 0.30 | 40.0 | ◎ | ◎ | ◎ |
| 380 | 67.20 | 28.95 | 2.00 | 1.50 | 0.0010 | 0 | 0.05 | 0.30 | 40.0 | ◎ | ◎ | ◎ |
| 381 | 69.90 | 25.75 | 2.00 | 2.00 | 0 | 0 | 0.05 | 0.30 | 40.0 | X | ○ | ◎ |
| 382 | 69.90 | 25.75 | 2.00 | 2.00 | 0.0005 | 0 | 0.05 | 0.30 | 40.0 | X | ○ | ◎ |
| 383 | 69.90 | 25.75 | 2.00 | 2.00 | 0.0010 | 0 | 0.05 | 0.30 | 40.0 | X | ○ | ◎ |
| 384 | 69.90 | 25.75 | 2.00 | 2.00 | 0.0020 | 0 | 0.05 | 0.30 | 40.0 | ◎ | ○ | ◎ |
| 385 | 58.20 | 38.74 | 2.00 | 0 | 0.0075 | 0 | 0.05 | 1.00 | 40.0 | X | ◎ | ◎ |
| 386 | 58.20 | 38.74 | 2.00 | 0 | 0.0150 | 0 | 0.05 | 1.00 | 40.0 | X | ◎ | ◎ |
| 387 | 58.20 | 38.72 | 2.00 | 0 | 0.0300 | 0 | 0.05 | 1.00 | 40.0 | X | ◎ | ◎ |
| 388 | 58.70 | 38.15 | 2.00 | 0.10 | 0 | 0 | 0.05 | 1.00 | 40.0 | X | ◎ | ◎ |
| 389 | 58.70 | 38.14 | 2.00 | 0.10 | 0.0075 | 0 | 0.05 | 1.00 | 40.0 | X | ◎ | ◎ |
| 390 | 58.70 | 38.14 | 2.00 | 0.10 | 0.0150 | 0 | 0.05 | 1.00 | 40.0 | X | ◎ | ◎ |
| 391 | 58.70 | 38.13 | 2.00 | 0.10 | 0.0200 | 0 | 0.05 | 1.00 | 40.0 | X | ◎ | ◎ |
| 392 | 58.70 | 38.12 | 2.00 | 0.10 | 0.0300 | 0 | 0.05 | 1.00 | 40.0 | ◎ | ◎ | ◎ |
| 393 | 59.25 | 37.50 | 2.00 | 0.20 | 0 | 0 | 0.05 | 1.00 | 40.0 | X | ◎ | ◎ |
| 394 | 59.25 | 37.49 | 2.00 | 0.20 | 0.0075 | 0 | 0.05 | 1.00 | 40.0 | X | ◎ | ◎ |

TABLE 16-continued

| No. | Cu | Zn | Bi | Si | B | Al | Sn | Ni | Zinc equivalent | Casting cracking resistance | Machinability | Mechanical properties |
|---|---|---|---|---|---|---|---|---|---|---|---|---|
| 395 | 59.25 | 37.49 | 2.00 | 0.20 | 0.0150 | 0 | 0.05 | 1.00 | 40.0 | X | ◎ | ◎ |
| 396 | 59.25 | 37.48 | 2.00 | 0.20 | 0.0200 | 0 | 0.05 | 1.00 | 40.0 | X | ◎ | ◎ |

TABLE 17

| No. | Cu | Zn | Bi | Si | B | Al | Sn | Ni | Zinc equivalent | Casting cracking resistance | Machinability | Mechanical properties |
|---|---|---|---|---|---|---|---|---|---|---|---|---|
| 397 | 59.25 | 37.48 | 2.00 | 0.20 | 0.0250 | 0 | 0.05 | 1.00 | 40.0 | ◎ | ◎ | ◎ |
| 398 | 59.25 | 37.47 | 2.00 | 0.20 | 0.0300 | 0 | 0.05 | 1.00 | 40.0 | ◎ | ◎ | ◎ |
| 399 | 59.80 | 36.85 | 2.00 | 0.30 | 0 | 0 | 0.05 | 1.00 | 40.0 | X | ◎ | ◎ |
| 400 | 59.80 | 36.84 | 2.00 | 0.30 | 0.0075 | 0 | 0.05 | 1.00 | 40.0 | X | ◎ | ◎ |
| 401 | 59.80 | 36.84 | 2.00 | 0.30 | 0.0150 | 0 | 0.05 | 1.00 | 40.0 | X | ◎ | ◎ |
| 402 | 59.80 | 36.83 | 2.00 | 0.30 | 0.0200 | 0 | 0.05 | 1.00 | 40.0 | ◎ | ◎ | ◎ |
| 403 | 59.80 | 36.83 | 2.00 | 0.30 | 0.0250 | 0 | 0.05 | 1.00 | 40.0 | ◎ | ◎ | ◎ |
| 404 | 59.80 | 36.82 | 2.00 | 0.30 | 0.0300 | 0 | 0.05 | 1.00 | 40.0 | ◎ | ◎ | ◎ |
| 405 | 60.90 | 35.55 | 2.00 | 0.50 | 0.0040 | 0 | 0.05 | 1.00 | 40.0 | X | ◎ | ◎ |
| 406 | 60.90 | 35.54 | 2.00 | 0.50 | 0.0075 | 0 | 0.05 | 1.00 | 40.0 | X | ◎ | ◎ |
| 407 | 60.90 | 35.54 | 2.00 | 0.50 | 0.0150 | 0 | 0.05 | 1.00 | 40.0 | X | ◎ | ◎ |
| 408 | 60.90 | 35.53 | 2.00 | 0.50 | 0.0200 | 0 | 0.05 | 1.00 | 40.0 | ◎ | ◎ | ◎ |
| 409 | 63.60 | 32.35 | 2.00 | 1.00 | 0.0010 | 0 | 0.05 | 1.00 | 40.0 | X | ◎ | ◎ |
| 410 | 63.60 | 32.35 | 2.00 | 1.00 | 0.0020 | 0 | 0.05 | 1.00 | 40.0 | X | ◎ | ◎ |
| 411 | 63.60 | 32.35 | 2.00 | 1.00 | 0.0040 | 0 | 0.05 | 1.00 | 40.0 | ◎ | ◎ | ◎ |
| 412 | 63.60 | 32.34 | 2.00 | 1.00 | 0.0075 | 0 | 0.05 | 1.00 | 40.0 | ◎ | ◎ | ◎ |
| 413 | 66.30 | 29.15 | 2.00 | 1.50 | 0.0010 | 0 | 0.05 | 1.00 | 40.0 | X | ◎ | ◎ |
| 414 | 66.30 | 29.15 | 2.00 | 1.50 | 0.0020 | 0 | 0.05 | 1.00 | 40.0 | X | ◎ | ◎ |
| 415 | 66.30 | 29.15 | 2.00 | 1.50 | 0.0040 | 0 | 0.05 | 1.00 | 40.0 | X | ◎ | ◎ |
| 416 | 66.30 | 29.14 | 2.00 | 1.50 | 0.0075 | 0 | 0.05 | 1.00 | 40.0 | X | ◎ | ◎ |
| 417 | 66.30 | 29.14 | 2.00 | 1.50 | 0.0150 | 0 | 0.05 | 1.00 | 40.0 | ◎ | ◎ | ◎ |
| 418 | 69.00 | 25.95 | 2.00 | 2.00 | 0.0005 | 0 | 0.05 | 1.00 | 40.0 | X | ○ | ◎ |
| 419 | 69.00 | 25.95 | 2.00 | 2.00 | 0.0010 | 0 | 0.05 | 1.00 | 40.0 | X | ○ | ◎ |
| 420 | 69.00 | 25.95 | 2.00 | 2.00 | 0.0020 | 0 | 0.05 | 1.00 | 40.0 | X | ○ | ◎ |
| 421 | 69.00 | 25.94 | 2.00 | 2.00 | 0.0075 | 0 | 0.05 | 1.00 | 40.0 | X | ○ | ◎ |
| 422 | 69.00 | 25.94 | 2.00 | 2.00 | 0.0150 | 0 | 0.05 | 1.00 | 40.0 | ◎ | ○ | ◎ |
| 423 | 57.30 | 38.82 | 2.00 | 0.30 | 0.0300 | 0 | 0.05 | 1.50 | 41.8 | ◎ | ◎ | ◎ |
| 424 | 56.70 | 38.92 | 2.00 | 0.30 | 0.0300 | 0 | 0.05 | 2.00 | 41.8 | ◎ | ◎ | ○ |

TABLE 18

| No. | Cu | Zn | Bi | Si | B | Al | Sn | Ni | Fe | P | Mn | Pb | Zinc equivalent | Casting cracking resistance | Machinability | Mechanical properties |
|---|---|---|---|---|---|---|---|---|---|---|---|---|---|---|---|---|
| 425 | 61.00 | 36.35 | 2.0 | 0.20 | 0.0050 | 0.15 | 0.05 | 0.05 | 0 | 0 | 0.20 | 0 | 40.0 | ○ | ◎ | ◎ |
| 426 | 61.00 | 36.25 | 2.0 | 0.20 | 0.0050 | 0.15 | 0.05 | 0.05 | 0 | 0 | 0.30 | 0 | 39.9 | X | ◎ | ◎ |
| 427 | 63.70 | 33.05 | 2.0 | 0.60 | 0.0010 | 0.35 | 0.05 | 0.05 | 0 | 0 | 0.20 | 0 | 40.0 | ○ | ◎ | ◎ |
| 428 | 63.70 | 32.95 | 2.0 | 0.60 | 0.0010 | 0.35 | 0.05 | 0.05 | 0 | 0 | 0.30 | 0 | 40.0 | X | ◎ | ◎ |
| 429 | 66.20 | 29.70 | 2.0 | 0.70 | 0.0015 | 1.00 | 0.05 | 0.05 | 0 | 0 | 0.30 | 0 | 40.0 | X | ◎ | ○ |
| 430 | 66.20 | 29.60 | 2.0 | 0.70 | 0.0015 | 1.00 | 0.05 | 0.05 | 0 | 0 | 0.40 | 0 | 39.9 | X | ◎ | ○ |
| 431 | 67.20 | 28.50 | 2.0 | 0.90 | 0.0015 | 1.00 | 0.05 | 0.05 | 0 | 0 | 0.30 | 0 | 40.0 | ◎ | ◎ | ○ |
| 432 | 67.20 | 28.40 | 2.0 | 0.90 | 0.0015 | 1.00 | 0.05 | 0.05 | 0 | 0 | 0.40 | 0 | 40.0 | ◎ | ◎ | ○ |
| 433 | 66.60 | 29.19 | 1.5 | 1.50 | 0.0075 | 0.10 | 0.05 | 0.05 | 0 | 0 | 1.00 | 0 | 41.0 | ◎ | ○ | ○ |
| 434 | 66.30 | 28.49 | 1.5 | 1.50 | 0.0075 | 0.10 | 0.05 | 0.05 | 0 | 0 | 2.00 | 0 | 41.0 | ◎ | ○ | ○ |
| 435 | 66.00 | 27.79 | 1.5 | 1.50 | 0.0075 | 0.10 | 0.05 | 0.05 | 0 | 0 | 3.00 | 0 | 41.0 | ○ | ○ | ○ |
| 436 | 65.70 | 27.09 | 1.5 | 1.50 | 0.0075 | 0.10 | 0.05 | 0.05 | 0 | 0 | 4.00 | 0 | 41.0 | ○ | ○ | ○ |

TABLE 19

| No. | Cu | Zn | Bi | Si | B | Al | Sn | Ni | Fe | P | Sb | Pb | Zinc equivalent | Casting cracking resistance | Machinability | Mechanical properties |
|---|---|---|---|---|---|---|---|---|---|---|---|---|---|---|---|---|
| 437 | 62.00 | 35.35 | 1.5 | 0.30 | 0.0050 | 0.35 | 0.10 | 0.10 | 0.10 | 0 | 0.20 | 0 | 40.2 | X | ◎ | ◎ |
| 438 | 62.00 | 35.45 | 1.5 | 0.30 | 0.0050 | 0.35 | 0.10 | 0.10 | 0.10 | 0 | 0.10 | 0 | 40.2 | X | ◎ | ◎ |
| 439 | 62.00 | 35.50 | 1.5 | 0.30 | 0.0050 | 0.35 | 0.10 | 0.10 | 0.10 | 0 | 0.05 | 0 | 40.2 | ◎ | ◎ | ◎ |
| 440 | 61.20 | 36.09 | 1.5 | 0.35 | 0.0100 | 0.35 | 0.10 | 0.10 | 0.10 | 0 | 0.20 | 0 | 41.2 | X | ◎ | ◎ |
| 441 | 61.20 | 36.19 | 1.5 | 0.35 | 0.0100 | 0.35 | 0.10 | 0.10 | 0.10 | 0 | 0.10 | 0 | 41.2 | ◎ | ◎ | ◎ |
| 442 | 61.20 | 36.24 | 1.5 | 0.35 | 0.0100 | 0.35 | 0.10 | 0.10 | 0.10 | 0 | 0.05 | 0 | 41.2 | ◎ | ◎ | ◎ |

TABLE 19-continued

| No. | Cu | Zn | Bi | Si | B | Al | Sn | Ni | Fe | P | Sb | Pb | Zinc equivalent | Casting cracking resistance | Machinability | Mechanical properties |
|---|---|---|---|---|---|---|---|---|---|---|---|---|---|---|---|---|
| 443 | 61.20 | 36.07 | 1.5 | 0.35 | 0.0300 | 0.35 | 0.10 | 0.10 | 0.10 | 0 | 0.20 | 0 | 41.2 | ◎ | ◎ | ◎ |
| 444 | 61.80 | 35.89 | 1.5 | 0.30 | 0.0075 | 0.30 | 0.05 | 0.05 | 0.10 | 0 | 0 | 0 | 40.3 | ◎ | ◎ | ◎ |
| 445 | 61.80 | 35.69 | 1.5 | 0.30 | 0.0075 | 0.30 | 0.05 | 0.05 | 0.30 | 0 | 0 | 0 | 40.3 | ◎ | ◎ | ◎ |
| 446 | 61.80 | 35.49 | 1.5 | 0.30 | 0.0075 | 0.30 | 0.05 | 0.05 | 0.50 | 0 | 0 | 0 | 40.3 | ◎ | ◎ | ◎ |
| 447 | 61.70 | 35.09 | 1.5 | 0.30 | 0.0075 | 0.30 | 0.05 | 0.05 | 1.00 | 0 | 0 | 0 | 40.3 | ◎ | ◎ | ○ |
| 448 | 61.50 | 35.94 | 1.5 | 0.30 | 0.0050 | 0.35 | 0.10 | 0.10 | 0.10 | 0.01 | 0 | 0.10 | 40.7 | ◎ | ◎ | ◎ |
| 449 | 61.50 | 35.74 | 1.5 | 0.30 | 0.0050 | 0.35 | 0.10 | 0.10 | 0.10 | 0.01 | 0 | 0.30 | 40.7 | ◎ | ◎ | ◎ |
| 450 | 61.50 | 35.54 | 1.5 | 0.30 | 0.0050 | 0.35 | 0.10 | 0.10 | 0.10 | 0.01 | 0 | 0.50 | 40.7 | ◎ | ◎ | ◎ |
| 451 | 62.00 | 35.54 | 1.5 | 0.30 | 0.0050 | 0.35 | 0.10 | 0.10 | 0.10 | 0.01 | 0 | 0 | 40.2 | ◎ | ◎ | ◎ |
| 452 | 62.00 | 35.60 | 1.5 | 0.30 | 0.0050 | 0.35 | 0.10 | 0.10 | 0.10 | 0.05 | 0 | 0 | 40.2 | ◎ | ◎ | ◎ |
| 453 | 62.00 | 35.45 | 1.5 | 0.30 | 0.0050 | 0.35 | 0.10 | 0.10 | 0.10 | 0.10 | 0 | 0 | 40.2 | ◎ | ◎ | ◎ |
| 454 | 62.00 | 35.35 | 1.5 | 0.30 | 0.0050 | 0.35 | 0.10 | 0.10 | 0.10 | 0.20 | 0 | 0 | 40.2 | ◎ | ◎ | ◎ |

TABLE 20

| No. | Cu | Zn | Bi | Si | B | Al | Sn | Ni | Fe | P | Mn | Cr | Sb | Pb | Zinc equivalent | Casting cracking resistance | Machinability | Mechanical properties |
|---|---|---|---|---|---|---|---|---|---|---|---|---|---|---|---|---|---|---|
| 455 | 62.00 | 33.85 | 2.00 | 0.30 | 0.0040 | 0.30 | 1.50 | 0.05 | 0 | 0 | 0 | 0 | 0 | 0 | 40.8 | ◎ | ◎ | ◎ |
| 456 | 61.50 | 36.39 | 1.25 | 0.35 | 0.0075 | 0.30 | 0.05 | 0.05 | 0.05 | 0 | 0 | 0 | 0 | 0.05 | 40.9 | ◎ | ◎ | ◎ |
| 457 | 62.00 | 35.55 | 1.50 | 0.30 | 0.0050 | 0.35 | 0.10 | 0.10 | 0.10 | 0 | 0 | 0 | 0 | 0 | 40.2 | ◎ | ◎ | ◎ |
| 458 | 61.70 | 36.19 | 1.25 | 0.35 | 0.0075 | 0.35 | 0.05 | 0.05 | 0.05 | 0 | 0 | 0 | 0 | 0 | 40.9 | ◎ | ◎ | ◎ |
| 459 | 62.00 | 35.79 | 1.25 | 0.35 | 0.0075 | 0.45 | 0.05 | 0.05 | 0.05 | 0 | 0 | 0 | 0 | 0 | 40.9 | ◎ | ◎ | ◎ |
| 460 | 62.20 | 35.49 | 1.25 | 0.35 | 0.0075 | 0.55 | 0.05 | 0.05 | 0.05 | 0 | 0 | 0 | 0 | 0 | 40.9 | ◎ | ◎ | ◎ |
| 461 | 61.80 | 36.04 | 1.25 | 0.35 | 0.0075 | 0.30 | 0.15 | 0.05 | 0.05 | 0 | 0 | 0 | 0 | 0 | 40.7 | ◎ | ◎ | ◎ |
| 462 | 61.80 | 35.94 | 1.25 | 0.35 | 0.0075 | 0.30 | 0.25 | 0.05 | 0.05 | 0 | 0 | 0 | 0 | 0 | 40.7 | ◎ | ◎ | ◎ |
| 463 | 61.90 | 35.74 | 1.25 | 0.35 | 0.0075 | 0.30 | 0.35 | 0.05 | 0.05 | 0 | 0 | 0 | 0 | 0 | 40.7 | ◎ | ◎ | ◎ |
| 464 | 62.00 | 35.54 | 1.25 | 0.35 | 0.0075 | 0.30 | 0.45 | 0.05 | 0.05 | 0 | 0 | 0 | 0 | 0 | 40.7 | ◎ | ◎ | ◎ |
| 465 | 61.90 | 35.79 | 1.25 | 0.35 | 0.0075 | 0.40 | 0.20 | 0.05 | 0.05 | 0 | 0 | 0 | 0 | 0 | 40.9 | ◎ | ◎ | ◎ |
| 466 | 62.00 | 35.24 | 1.70 | 0.35 | 0.0075 | 0.50 | 0.05 | 0.05 | 0.05 | 0 | 0 | 0 | 0 | 0.05 | 40.9 | ◎ | ◎ | ◎ |
| 467 | 62.50 | 34.72 | 1.50 | 0.30 | 0.0050 | 0.55 | 0.10 | 0.10 | 0.10 | 0.01 | 0 | 0 | 0.02 | 0.10 | 40.3 | ◎ | ◎ | ◎ |

TABLE 21

| No. | Cu | Zn | Bi | Si | B | Al | Sn | Ni | Fe | P | Mn | Cr | Sb | Pb | Zinc equivalent | Casting cracking resistance | Machinability |
|---|---|---|---|---|---|---|---|---|---|---|---|---|---|---|---|---|---|
| 468 | 61.00 | 37.16 | 1.25 | 0.35 | 0.0020 | 0.10 | 0.03 | 0.03 | 0.005 | 0.005 | 0.005 | 0.0025 | 0.01 | 0.05 | 40.8 | ◎ | ◎ |
| 469 | 61.20 | 36.69 | 1.25 | 0.35 | 0.0035 | 0.10 | 0.30 | 0.03 | 0.005 | 0.005 | 0.005 | 0.0025 | 0.01 | 0.05 | 40.8 | ◎ | ◎ |
| 470 | 61.30 | 36.44 | 1.25 | 0.35 | 0.0035 | 0.10 | 0.45 | 0.03 | 0.005 | 0.005 | 0.005 | 0.0025 | 0.01 | 0.05 | 40.8 | ◎ | ◎ |
| 471 | 61.20 | 36.43 | 1.50 | 0.30 | 0.0010 | 0.15 | 0.20 | 0.05 | 0.03 | 0.01 | 0.01 | 0.005 | 0.01 | 0.1 | 40.5 | ◎ | ◎ |
| 472 | 62.40 | 34.93 | 1.50 | 0.50 | 0.0010 | 0.15 | 0.30 | 0.05 | 0.03 | 0.01 | 0.01 | 0.005 | 0.01 | 0.1 | 40.5 | ◎ | ◎ |
| 473 | 63.50 | 33.53 | 1.50 | 0.70 | 0.0010 | 0.15 | 0.40 | 0.05 | 0.03 | 0.01 | 0.01 | 0.005 | 0.01 | 0.1 | 40.5 | ◎ | ◎ |
| 474 | 62.50 | 34.94 | 1.25 | 0.65 | 0.0035 | 0.10 | 0.45 | 0.03 | 0.005 | 0.005 | 0.005 | 0.0025 | 0.005 | 0.05 | 41.2 | ◎ | ◎ |
| 475 | 63.50 | 33.75 | 1.25 | 0.85 | 0.0025 | 0.10 | 0.45 | 0.03 | 0.005 | 0.005 | 0.005 | 0.0025 | 0.005 | 0.05 | 41.2 | ◎ | ◎ |
| 476 | 64.10 | 33.05 | 1.25 | 0.95 | 0.0015 | 0.10 | 0.45 | 0.03 | 0.005 | 0.005 | 0.005 | 0.0025 | 0.005 | 0.05 | 41.2 | ◎ | ◎ |
| 477 | 63.50 | 33.77 | 1.25 | 0.85 | 0.0015 | 0.10 | 0.40 | 0.03 | 0.03 | 0.005 | 0.005 | 0.0025 | 0.005 | 0.05 | 41.2 | ◎ | ◎ |
| 478 | 63.00 | 34.05 | 1.50 | 0.60 | 0.0030 | 0.15 | 0.50 | 0.05 | 0.01 | 0.01 | 0.01 | 0.005 | 0.01 | 0.1 | 40.5 | ◎ | ◎ |
| 479 | 64.00 | 32.85 | 1.50 | 0.80 | 0.0020 | 0.15 | 0.50 | 0.05 | 0.01 | 0.01 | 0.01 | 0.005 | 0.01 | 0.1 | 40.6 | ◎ | ◎ |
| 480 | 64.60 | 32.15 | 1.50 | 0.90 | 0.0010 | 0.15 | 0.50 | 0.05 | 0.01 | 0.01 | 0.01 | 0.005 | 0.01 | 0.1 | 40.5 | ◎ | ◎ |
| 481 | 64.00 | 32.88 | 1.50 | 0.80 | 0.0010 | 0.15 | 0.45 | 0.05 | 0.03 | 0.01 | 0.01 | 0.005 | 0.01 | 0.1 | 40.6 | ◎ | ◎ |
| 482 | 63.00 | 34.23 | 1.50 | 0.65 | 0.0010 | 0.30 | 0.10 | 0.05 | 0.03 | 0.01 | 0.01 | 0.005 | 0.01 | 0.1 | 41.0 | ◎ | ◎ |
| 483 | 64.40 | 32.48 | 1.50 | 0.80 | 0.0010 | 0.50 | 0.10 | 0.05 | 0.03 | 0.01 | 0.01 | 0.005 | 0.01 | 0.1 | 41.0 | ◎ | ◎ |
| 484 | 65.80 | 30.73 | 1.50 | 0.95 | 0.0010 | 0.70 | 0.10 | 0.05 | 0.03 | 0.01 | 0.01 | 0.005 | 0.01 | 0.1 | 41.0 | ◎ | ◎ |
| 485 | 63.50 | 33.78 | 1.25 | 0.75 | 0.0010 | 0.30 | 0.20 | 0.05 | 0.03 | 0.01 | 0.01 | 0.005 | 0.01 | 0.1 | 41.1 | ◎ | ◎ |
| 486 | 64.00 | 33.08 | 1.25 | 0.85 | 0.0010 | 0.30 | 0.30 | 0.05 | 0.03 | 0.01 | 0.01 | 0.005 | 0.01 | 0.1 | 41.2 | ◎ | ◎ |
| 487 | 64.30 | 32.63 | 1.25 | 0.90 | 0.0010 | 0.30 | 0.40 | 0.05 | 0.03 | 0.01 | 0.01 | 0.005 | 0.01 | 0.1 | 41.2 | ◎ | ◎ |
| 488 | 64.20 | 32.93 | 1.25 | 0.80 | 0.0015 | 0.45 | 0.15 | 0.05 | 0.03 | 0.01 | 0.01 | 0.005 | 0.01 | 0.1 | 41.1 | ◎ | ◎ |
| 489 | 64.20 | 32.83 | 1.25 | 0.80 | 0.0015 | 0.45 | 0.25 | 0.05 | 0.03 | 0.01 | 0.01 | 0.005 | 0.01 | 0.1 | 41.1 | ◎ | ◎ |
| 490 | 64.20 | 32.73 | 1.25 | 0.80 | 0.0015 | 0.45 | 0.35 | 0.05 | 0.03 | 0.01 | 0.01 | 0.005 | 0.01 | 0.1 | 41.2 | ◎ | ◎ |

TABLE 22

| No. | Cu | Zn | Bi | Si | B | Al | Sn | Ni | Fe | P | Mn | Cr | Sb | Pb | Zinc equivalent | Casting cracking resistance | Machin-ability |
|---|---|---|---|---|---|---|---|---|---|---|---|---|---|---|---|---|---|
| 491 | 61.50 | 36.44 | 1.25 | 0.35 | 0.0075 | 0.30 | 0.05 | 0.05 | 0.05 | 0 | 0 | 0 | 0 | 0 | 40.9 | ◎ | ◎ |
| 492 | 61.50 | 35.99 | 1.25 | 0.35 | 0.0075 | 0.20 | 0.60 | 0.05 | 0.05 | 0 | 0 | 0 | 0 | 0 | 40.9 | ◎ | ◎ |
| 493 | 61.50 | 35.59 | 1.25 | 0.35 | 0.0075 | 0.20 | 1.00 | 0.05 | 0.05 | 0 | 0 | 0 | 0 | 0 | 41.2 | ◎ | ◎ |
| 494 | 61.50 | 35.19 | 1.25 | 0.35 | 0.0075 | 0.10 | 1.50 | 0.05 | 0.05 | 0 | 0 | 0 | 0 | 0 | 41.2 | ◎ | ◎ |
| 495 | 64.40 | 32.34 | 1.70 | 0.35 | 0.0075 | 1.00 | 0.05 | 0.05 | 0.05 | 0 | 0 | 0 | 0 | 0.05 | 40.0 | ◎ | ◎ |
| 496 | 67.40 | 28.34 | 1.70 | 0.35 | 0.0075 | 2.00 | 0.05 | 0.05 | 0.05 | 0 | 0 | 0 | 0 | 0.05 | 40.0 | ◎ | ◎ |
| 497 | 70.40 | 24.34 | 1.70 | 0.35 | 0.0075 | 3.00 | 0.05 | 0.05 | 0.05 | 0 | 0 | 0 | 0 | 0.05 | 40.0 | ◎ | ◎ |
| 498 | 73.40 | 20.32 | 1.70 | 0.35 | 0.0300 | 4.00 | 0.05 | 0.05 | 0.05 | 0 | 0 | 0 | 0 | 0.05 | 40.0 | ◎ | ◎ |
| 499 | 68.00 | 26.77 | 1.70 | 0.35 | 0.0300 | 2.00 | 1.00 | 0.05 | 0.05 | 0 | 0 | 0 | 0 | 0.05 | 40.0 | ◎ | ◎ |
| 500 | 73.80 | 19.39 | 1.70 | 0.35 | 0.0150 | 4.00 | 0.60 | 0.05 | 0.05 | 0 | 0 | 0 | 0 | 0.05 | 40.0 | ◎ | ◎ |
| 501 | 65.70 | 31.34 | 1.25 | 1.00 | 0.0015 | 0.10 | 0.50 | 0.03 | 0.01 | 0.005 | 0.005 | 0.0025 | 0.005 | 0.05 | 40.0 | ◎ | ◎ |
| 502 | 66.00 | 30.54 | 1.25 | 1.00 | 0.0015 | 0.10 | 1.00 | 0.03 | 0.01 | 0.005 | 0.005 | 0.0025 | 0.005 | 0.05 | 40.0 | ◎ | ◎ |
| 503 | 67.60 | 28.24 | 1.25 | 1.30 | 0.0015 | 1.00 | 0.50 | 0.03 | 0.01 | 0.005 | 0.005 | 0.0025 | 0.005 | 0.05 | 42.0 | ◎ | ◎ |
| 504 | 69.20 | 26.09 | 1.25 | 1.60 | 0.0015 | 1.25 | 0.50 | 0.03 | 0.01 | 0.005 | 0.005 | 0.0025 | 0.005 | 0.05 | 42.6 | ◎ | ◎ |
| 505 | 70.80 | 23.94 | 1.25 | 1.90 | 0.0030 | 1.50 | 0.50 | 0.03 | 0.01 | 0.005 | 0.005 | 0.0025 | 0.005 | 0.05 | 43.1 | ◎ | ◎ |
| 506 | 67.20 | 28.43 | 1.25 | 0.70 | 0.0015 | 1.50 | 0.70 | 0.05 | 0.03 | 0.01 | 0.01 | 0.005 | 0.01 | 0.1 | 41.0 | ◎ | ◎ |
| 507 | 70.40 | 24.63 | 1.25 | 1.30 | 0.0015 | 1.50 | 0.70 | 0.05 | 0.03 | 0.01 | 0.01 | 0.005 | 0.01 | 0.1 | 41.0 | ◎ | ◎ |
| 508 | 67.30 | 28.53 | 1.25 | 1.00 | 0.0015 | 1.00 | 0.70 | 0.05 | 0.03 | 0.01 | 0.01 | 0.005 | 0.01 | 0.1 | 41.0 | ◎ | ◎ |
| 509 | 70.20 | 24.63 | 1.25 | 1.00 | 0.0015 | 2.00 | 0.70 | 0.05 | 0.03 | 0.01 | 0.01 | 0.005 | 0.01 | 0.1 | 41.0 | ◎ | ◎ |
| 510 | 68.70 | 26.83 | 1.25 | 1.00 | 0.0015 | 1.50 | 0.50 | 0.05 | 0.03 | 0.01 | 0.01 | 0.005 | 0.01 | 0.1 | 41.0 | ◎ | ◎ |
| 511 | 69.00 | 26.03 | 1.25 | 1.00 | 0.0015 | 1.50 | 1.00 | 0.05 | 0.03 | 0.01 | 0.01 | 0.005 | 0.01 | 0.1 | 41.0 | ◎ | ◎ |
| 512 | 69.90 | 25.18 | 1.50 | 1.00 | 0.0010 | 1.50 | 0.70 | 0.05 | 0.03 | 0.01 | 0.01 | 0.005 | 0.01 | 0.1 | 40.0 | ◎ | ◎ |
| 513 | 67.60 | 27.48 | 1.50 | 1.00 | 0.0010 | 1.50 | 0.70 | 0.05 | 0.03 | 0.01 | 0.01 | 0.005 | 0.01 | 0.1 | 42.0 | ◎ | ◎ |
| 514 | 67.90 | 27.78 | 1.25 | 0.85 | 0.0015 | 1.50 | 0.50 | 0.05 | 0.03 | 0.01 | 0.01 | 0.005 | 0.01 | 0.1 | 41.0 | ◎ | ◎ |
| 515 | 68.00 | 27.48 | 1.25 | 0.85 | 0.0015 | 1.50 | 0.70 | 0.05 | 0.03 | 0.01 | 0.01 | 0.005 | 0.01 | 0.1 | 41.0 | ◎ | ◎ |

TABLE 23

| Cu | Sb | Pb | Bi | Zn | Sn | Fe | Ni | Al | Si | P | B | Mn | Others | Total | Zinc equiv-alent | Casting crack-ing resist-ance | Ma-chin-abil-ity | Me-chani-cal proper-ties | Corro-sion resist-ance |
|---|---|---|---|---|---|---|---|---|---|---|---|---|---|---|---|---|---|---|---|
| 60.4 | 0 | 0.110 | 0.800 | 38.1 | 0.31 | 0 | 0.05 | 0 | 0.11 | 0.05 | 0.0080 | 0 | 0.08 | 100.018 | 40.5 | X | ◎ | ◎ | ○ |

Examples 1 to 4

Casting cracking does not take place for the brass in which 2% of Pb has been added to brass with Cu/Zn=60/40. The addition of Bi as an alternative to Pb as a free cutting component, however, resulted in the occurrence of casting cracking. As with Pb, Bi improves machinability but is highly likely to cause casting cracking.

Examples 5 to 10

The casting cracking of the brass with Bi added thereto can be prevented by the addition of B and Si. When the Cu content is more than 750% by weight as in Example 5, casting cracking is likely to occur. On the other hand, even when the Cu content is lowered to 55% by weight, casting cracking does not occur. As the Zn content increases, the proportion of the β phase increases resulting in lowered elongation of the material. For the above reason, the Cu content is not more than 75% by weight from the viewpoint of providing good casting cracking resistance while the Cu content is not less than 55% by weight from the viewpoint of simultaneously realizing good casting cracking resistance and good mechanical properties.

Examples 11 to 16

The effect of preventing casting cracking increases with increasing the addition amount of B and Si. The addition of an excessive amount of B renders the material hard and brittle. That is, the elongation of the material lowers with increasing the cutting resistance. When the influence of B on the machinability and mechanical properties is taken into consideration, the addition amount of B is not more than 0.3% by weight, preferably not more than 0.03% by weight, more preferably not more than 0.01% by weight.

Examples 17 to 100

The machinability improved with increasing the addition amount of Bi, and the contemplated effect could be attained by the addition of Bi in an amount of not less than 0.3% by weight. Since, however, Bi is an expensive element, the addition of Bi in an unnecessarily large amount increases the material cost. For this reason, the addition amount of Bi is preferably not more than 4% by weight. Further, it should be noted that, since Bi becomes a starting point of casting cracking, the susceptibility of the material to casting cracking varies depending upon the addition amount of Bi. The larger the addition amount of Bi, the higher the susceptibility of the material to casting cracking. Accordingly, increasing the addition amount of B and Si is preferred from the viewpoint of preventing cracking.

When the addition amount of Bi is less than 1.5% by weight, the addition amount of B and Si necessary for preventing cracking can be reduced. Based on the addition amount of B and Si necessary for the case where Bi is 1.5% by weight ≤Bi≤4% by weight, a 0.2-fold addition amount in the case of 0.3% by weight ≤Bi<0.75% by weight and a 0.85-fold addition amount in the case of 0.75% by weight ≤Bi<1.5% by weight can prevent casting cracking.

Examples 101 to 147

The results of Examples 101 to 107 show that, when the apparent Zn equivalent is 37 to 45%, good castability can be realized. When the Zn equivalent is less than 37%, dendrite of proeutectic α phase is formed resulting in increased susceptibility of the material to casting cracking. On the other hand, when the Zn equivalent exceeds 45%, the proportion of β phase increases resulting in lowered elongation of the material.

The results of Examples 108 to 147 show that the susceptibility of the material to casting cracking varies depending upon the apparent Zn equivalent. As the apparent Zn equivalent increases, the susceptibility of the material to casting cracking lowers and, thus, the addition amount of B and Si necessary for preventing the casting cracking can be reduced. Based on the addition amount of B and Si necessary for the case where the apparent Zn content is not less than 39% and less than 41%, a one-fold addition amount in the case of an apparent Zn content of not less than 37% and less than 39% and a 0.75-fold addition amount in the case of an apparent Zn content of not less than 41% and not more than 45% can prevent casting cracking.

Examples 148 to 228

The influence of the addition of not less than 0.1% by weight and less than 0.30% by weight of Al on casting cracking was not observed. When the addition amount of Al is not less than 0.3% by weight, the casting cracking is likely to occur, and, thus, in this case, the addition amount of B and Si should be increased. Although increasing the addition amount of B and Si can increase the amount of Al added, the addition of an excessive amount of Al disadvantageously lowers the elongation of the material. Accordingly, the addition amount of Al should be not more than 2% by weight.

Examples 229 to 325

The addition of Sn in an amount of not less than 1% by weight is likely to affect casting cracking. This tendency is particularly significant when the addition amount of Sn is not less than 1.5% by weight. The disadvantageous tendency can be suppressed by increasing the addition amount of B and Si.

Examples 326 to 424

The addition of Ni in an amount of not less than 0.1% by weight is likely to affect casting cracking. In particular, when Ni is added, this influence can be eliminated by adding Si. As with Al and Sn, the susceptibility of the material to casting cracking increases with increasing the addition amount of Ni. In this case, preferably, the addition amount of B and Si is increased when the susceptibility of the material to casting cracking increases.

Examples 425 to 436

Mn affects the susceptibility of the material to casting cracking. When the addition amount of Mn is less than 0.30% by weight, this influence can be eliminated. When not less than 0.3% by weight of Mn is added, preferably, the addition amount of Si is increased to not less than 0.7% by weight.

Examples 437 to 454

The results of Examples 437 to 454 show that the presence of unavoidable impurities is tolerated and increasing the addition amount of B and Si can increase the tolerance of the unavoidable impurities. Sb is likely to cause casting cracking. Sb may be added in an amount of not more than 0.2% by weight by increasing the addition amount of B or Si. Likewise, not more than 1% by weight of Fe, not more than 0.5% by weight of Pb, and not more than 0.2% by weight of P can be added. It is suggested that these elements could be added in larger amounts by increasing the addition amount of B and Si to a larger amount than indicated in these Examples.

Examples 455 to 467

Increasing the addition amount of B and Si can effectively prevent casting cracking. The addition of B and Si in an excessive amount, however, leads to a deterioration in machinability and mechanical properties. The chemical compositions indicated in Examples 455 to 467 can realize good balance among castability, machinability, and mechanical properties.

Examples 468 to 490

As described above, B is likely to form a compound with Fe and Cr. The formation of the compound is sometimes causative of a poor appearance in surface processing such as polishing. Accordingly, for example, in decorative components which undergo polish finishing, preferably, the content of Fe and Cr is minimized and, at the same time, the addition amount of B is also lowered to an as small as possible amount. Reducing the addition amount of B is likely to increase the susceptibility of the material to casting cracking. However, the casting cracking can be prevented by increasing the addition amount of Si. The chemical compositions indicated in Examples 468 to 490 can realize good castability and surface processability without deteriorating the machinability and mechanical properties.

Examples 491 to 515

The addition of Sn can improve the corrosion resistance. Good corrosion resistance can be realized by adding not less than 1% by weight of Sn. As can be seen from the results of Examples 495 to 498, the corrosion resistance can also be improved by increasing the content of Cu. As can be seen from Examples 499 and 500, the corrosion resistance can be significantly improved by increasing the content of Cu and, at the same time, adding Sn. The chemical compositions indicated in Examples 501 to 515 can realize good castability and corrosion resistance without deteriorating the machinability, mechanical properties and surface processability.

For all the Examples 1 to 515 except for Example 5, the proportion of α phase+β phase is not less than 85%.

The invention claimed is:

1. A brass having a crystal texture in which the total proportion of α phase and β phase is not less than 85%, and consisting essentially of:

not less than 55% by weight and not more than 75% by weight of copper (Cu), not less than 0.3% by weight and not more than 4.0% by weight of bismuth (Bi), at least one of boron (B) and silicon (Si), with a content of Si being from 0% to 2.0% by weight and a content of B being from 0% to 0.3% by weight, and, further, at least two constituents selected from the group consisting of not less than 0.1% by weight and not more than 2.0% by weight of nickel (Ni), not less than 0.1% by weight and not more than 2.0% by weight of aluminum (Al), and not less than 0.1% by weight and not more than 3.0% by weight of tin (Sn), and the balance consisting of (Zn) Zn and unavoidable impurities, an apparent content of Zn is not less than 37% and not more than 45%, the content of B and the content of Si being y % by weight and x % by weight, respectively, which at the same time satisfy one of the following relational expressions (i)-(iii) when Ni is present in the brass, satisfy one of the following relational expressions (iv)-(vi) when Al is present in the brass, and satisfy one of the following relational expressions (vii)-(ix) when Sn is present in the brass, (i) when Ni is not less than 0.1% by weight and less than 0.3% by weight, $0<y\leq 0.3$ when $0.05ab \leq x\leq 0.75ab$ and $0<y\leq 0.3$ when $0.75ab < x\leq 2.0$, (ii) when Ni is not less than 0.3% by weight and less than 1.0% by weight, $-0.15x+0.03ab < y\leq 0.3$ when $0.05ab\ x\leq 0.2ab$, $0<y\leq 0.3$ when $0.2ab < x\leq 0.75ab$, $0 \leq y\leq 0.3$ when $0.75ab < x\leq 1.75ab$, and $0.004x-0.007(2 - ab)<y\leq 0.3$ when $1.75ab<x\leq 2.0$, (iii) when Ni is not less than 1.0% by weight and not more than 2.0% by weight, $0.02ab<y\leq 0.3$ when $0.05ab\leq x\leq 0.2ab$, $-0.05x+0.03ab<y\leq 0.3$ when $0.2ab<x\leq 0.3ab$, $0.015ab<y\leq 0.3$ when $0.3ab<x\leq 0.5ab$, $-0.026x+0.028ab<y\leq 0.3$ when $0.5ab<x\leq 1.0ab$, $0.011x-0.009(2-ab)<y\leq 0.3$ when $1.0ab<x\leq 1.5ab$, and $0.0075ab<y\leq 0.3$ when $1.5ab<x\leq 2.0$, (iv) when Al is not less than 0.1% by weight and less than 0.3% by weight, $0\leq y\leq 0.3$, $0\leq x\leq 2.0$, and $y>-0.15x+0.015ab$ (v) when Al is not less than 0.3% by weight and less than 1.0% by weight, $-0.15x+0.015ab<y\leq 0.3$ when $0\leq x\leq 0.1ab$, $0<y\leq 0.3$ when $0.1ab<x\leq 1.5ab$, and $0.002x-0.003(2-ab)<y\leq 0.3$ when $1.5ab<x\leq 2.0$, (vi) when Al is not less than 1.0% by weight and not more than 2.0% by weight, $0.004ab<y\leq 0.3$ when $0.05ab\leq x\leq 0.3ab$, $-0.01x+0.007ab<y\leq 0.3$ when $0.3ab<x\leq 0.5ab$, $-0.004x+0.004ab<y\leq 0.3$ when $0.5ab<x\leq 1.0ab$, $0.001x-0.001(2-ab)<y\leq 0.3$ when $1.0ab<x\leq 1.5ab$, and $0.0005ab<y\leq 0.3$ when $1.5ab<x\leq 2.0$, (vii) when Sn is not less than 0.1% by weight and less than 0.3% by weight, $-0.16x+0.02ab<y\leq 0.3$ when $0\leq x\leq 0.125ab$, $0<y\leq 0.3$ when $0.125ab<x\leq 0.4ab$, and $0\leq y\leq 0.3$ when $0.4ab <x\leq 2.0$, (viii) when Sn is not less than 0.3% by weight and less than 1.5% by weight, $-0.08x+0.02ab<y\leq 0.3$ when $0\leq x\leq 0.25ab$, $0<y\leq 0.3$ when $0.25ab<x\leq 1.25ab$, $0\leq y\leq 0.3$ when $1.25ab<x\leq 1.75ab$, and $0.002x-0.0035(2-ab)<y\leq 0.3$ when $1.75ab<x\leq 2.0$, (ix) when Sn is not less than 1.5% by weight and not more than 3.0% by weight, $0.025ab<y\leq 0.3$ when $0\leq x\leq 0.1ab$, $-0.105x+0.0355ab<y\leq 0.3$ when $0.1ab<x\leq 0.3ab$, $0.004ab<y\leq 0.3$ when $0.3ab<x\leq 0.5ab$, $0.007x+0.0005ab<y\leq 0.3$ when $0.5ab<x\leq 1.0ab$, and $0.045x-0.0375(2-ab)<y\leq 0.3$ when $1.0ab<x\leq 2.0$, wherein a is 0.2 when Bi is 0.3% by weight $\leq Bi <0.75\%$ by weight; 0.85 when Bi is 0.75% by weight $\leq Bi <1.5\%$ by weight; and 1 when Bi is 1.5% by weight $\leq Bi \leq 4.0\%$ by weight, and b is 1 when the apparent content of zinc (Zn) is not less than 37% and less than 41%; and 0.75 when the apparent content of Zn is not less than 41% and not more than 45%.

2. A brass comprising the brass according to claim 1 further including not less than 0.3% by weight and not more than 4.0% by weight of manganese (Mn), and the content of silicon (Si) is not less than 0.7% by weight and not more than 2.0% by weight.

3. A brass comprising the brass according to claim 1 further including at least 0.005% by weight of Mn and less than 0.3% by weight of Mn.

4. A faucet metal fitting comprising the brass according to claim 1.

5. The faucet metal fitting according to claim 4 produced by metal mold casting.

6. A faucet metal fitting comprising the brass according to claim 2.

7. The faucet metal fitting according to claim 6 produced by metal mold casting.

8. A faucet metal fitting comprising the brass according to claim 3.

9. The faucet metal fitting according to claim 8 produced by metal mold casting.

* * * * *